US009148734B2

(12) United States Patent
Hillbratt et al.

(10) Patent No.: US 9,148,734 B2
(45) Date of Patent: Sep. 29, 2015

(54) FEEDBACK PATH EVALUATION IMPLEMENTED WITH LIMITED SIGNAL PROCESSING

(71) Applicant: Cochlear Limited, Macquarie Universiy, NSW (AU)

(72) Inventors: Martin Evert Gustaf Hillbratt, Lindome (SE); Mats Höjlund, Mölnlycke (SE)

(73) Assignee: COCHLEAR LIMITED, Macquarie University, NSW (AU)

( * ) Notice: Subject to any disclaimer, the term of this patent is extended or adjusted under 35 U.S.C. 154(b) by 0 days.

(21) Appl. No.: 13/910,590

(22) Filed: Jun. 5, 2013

(65) Prior Publication Data

US 2014/0363036 A1 Dec. 11, 2014

(51) Int. Cl.
*H04R 25/00* (2006.01)

(52) U.S. Cl.
CPC ..... *H04R 25/45* (2013.01); *H04R 25/453* (2013.01); *H04R 25/505* (2013.01); *H04R 2225/43* (2013.01); *H04R 2225/67* (2013.01); *H04R 2430/01* (2013.01); *H04R 2460/01* (2013.01); *H04R 2460/03* (2013.01); *H04R 2460/13* (2013.01)

(58) Field of Classification Search
CPC ..... H04R 25/00; H04R 25/30; H04R 25/305; H04R 25/45; H04R 25/453; H04R 25/502; H04R 25/505; H04R 25/70; H04R 2225/41; H04R 2225/43; H04R 2225/49; H04R 2225/67; H04R 2460/01; H04R 2460/03; H04R 2460/13
USPC ..... 381/317, 318, 60, 71.11, 71.12, 93, 95, 381/96
See application file for complete search history.

(56) References Cited

U.S. PATENT DOCUMENTS

| | | | | |
|---|---|---|---|---|
| 5,266,919 | A | 11/1993 | Cook et al. | |
| RE34,961 | E | 6/1995 | Widin et al. | |
| 5,619,580 | A * | 4/1997 | Hansen | 381/314 |
| 6,072,884 | A | 6/2000 | Kates | |
| 6,118,877 | A | 9/2000 | Lindemann et al. | |
| 6,134,329 | A | 10/2000 | Gao et al. | |
| 6,219,427 | B1 * | 4/2001 | Kates et al. | 381/318 |
| 6,434,247 | B1 * | 8/2002 | Kates et al. | 381/312 |
| 6,687,377 | B2 | 2/2004 | Voix et al. | |
| 6,792,114 | B1 | 9/2004 | Kates et al. | |
| 7,010,135 | B2 | 3/2006 | Von Buol | |
| 7,058,182 | B2 | 6/2006 | Kates et al. | |
| 7,463,745 | B2 | 12/2008 | Miller, III | |
| 7,536,022 | B2 | 5/2009 | Von Buol | |
| 7,664,281 | B2 | 2/2010 | Merks | |
| 7,688,983 | B2 | 3/2010 | Voix et al. | |

(Continued)

FOREIGN PATENT DOCUMENTS

| | | | |
|---|---|---|---|
| EP | 1830603 | A2 | 9/2007 |
| EP | 2136575 | A2 | 12/2009 |

(Continued)

*Primary Examiner* — Curtis Kuntz
*Assistant Examiner* — Joshua A Kaufman
(74) *Attorney, Agent, or Firm* — Lowe Hauptman & Ham, LLP

(57) ABSTRACT

A method, including operating an adaptive system of a hearing prosthesis, and determining one or more feedback path parameters of the hearing prosthesis based on the operation of the adaptive system of the hearing prosthesis.

25 Claims, 11 Drawing Sheets

(56) References Cited

U.S. PATENT DOCUMENTS

| | | | | |
|---|---|---|---|---|
| 8,229,127 | B2 | 7/2012 | Jorgensen et al. | |
| 8,243,939 | B2 | 8/2012 | Perman | |
| 8,254,586 | B2 | 8/2012 | Voix et al. | |
| 8,254,587 | B2 | 8/2012 | Voix et al. | |
| 2001/0033664 | A1 | 10/2001 | Poux et al. | |
| 2005/0163331 | A1* | 7/2005 | Gao et al. | 381/93 |
| 2008/0260171 | A1 | 10/2008 | Nordahn et al. | |
| 2009/0067654 | A1* | 3/2009 | Klinkby et al. | 381/318 |
| 2009/0147977 | A1 | 6/2009 | Lamm et al. | |
| 2009/0316922 | A1* | 12/2009 | Merks et al. | 381/60 |
| 2010/0172507 | A1* | 7/2010 | Merks | 381/60 |
| 2010/0177917 | A1* | 7/2010 | Van Der Werf | 381/318 |
| 2010/0232634 | A1* | 9/2010 | Boldt | 381/318 |
| 2010/0296680 | A1* | 11/2010 | Korl et al. | 381/318 |
| 2010/0310103 | A1* | 12/2010 | Baechler et al. | 381/318 |
| 2011/0026746 | A1* | 2/2011 | Baechler et al. | 381/318 |
| 2012/0189130 | A1 | 7/2012 | Lee et al. | |
| 2013/0006042 | A1* | 1/2013 | Hillbratt et al. | 600/25 |
| 2014/0177890 | A1* | 6/2014 | Hojlund et al. | 381/318 |

FOREIGN PATENT DOCUMENTS

| | | | |
|---|---|---|---|
| EP | 2189006 | B1 | 6/2011 |
| WO | 2008/000843 | A2 | 1/2008 |

* cited by examiner

FEEDBACK PATH EVALUATION IMPLEMENTED WITH LIMITED SIGNAL PROCESSING

BACKGROUND

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound.

Conductive hearing loss occurs when the normal mechanical pathways that provide sound to hair cells in the cochlea are impeded, for example, by damage to the ossicular chain or the ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, which rely primarily on the principles of air conduction, certain types of hearing prostheses commonly referred to as bone conduction devices, convert a received sound into vibrations. The vibrations are transferred through the skull to the cochlea causing generation of nerve impulses, which result in the perception of the received sound. In some instances, bone conduction devices can be used to treat single side deafness, where the bone conduction device is attached to the mastoid bone on the contra lateral side of the head from the functioning "ear" and transmission of the vibrations is transferred through the skull bone to the functioning ear. Bone conduction devices can be used, in some instances, to address pure conductive losses (faults on the pathway towards the cochlea) or mixed hearing losses (faults on the pathway in combination with moderate sensoneural hearing loss in the cochlea).

SUMMARY

In accordance with one aspect, there is a method comprising operating an adaptive system of a hearing prosthesis, and determining one or more feedback path parameters of the hearing prosthesis based on the operation of the adaptive system of the hearing prosthesis.

In accordance with another aspect, there is a method comprising setting a gain margin of a hearing prosthesis based on an operation of an adaptive system of a feedback management system of the hearing prosthesis.

In accordance with another aspect, there is an apparatus comprising a hearing prosthesis including a feedback management system, wherein the hearing prosthesis is configured to output data indicative of operation of the feedback management system.

In accordance with another aspect, there is a non-transitory computer readable medium having recorded thereon, a computer program for fitting a hearing prosthesis, comprising code for analyzing an operation of a feedback management system of the hearing prosthesis, and code for at least partially fitting the hearing prosthesis to a recipient thereof based on the analysis of the of the operation of the feedback management system.

BRIEF DESCRIPTION OF THE DRAWINGS

Some embodiments are described below with reference to the attached drawings, in which.

DETAILED DESCRIPTION

Some and/or all embodiments of the technologies detailed herein by way of example and not by way of limitation can have utilitarian value when applied to various hearing prostheses. Two such exemplary hearing prostheses will first be described in the context of the human auditory system, followed by a description of some of the embodiments.

Figure 1A:
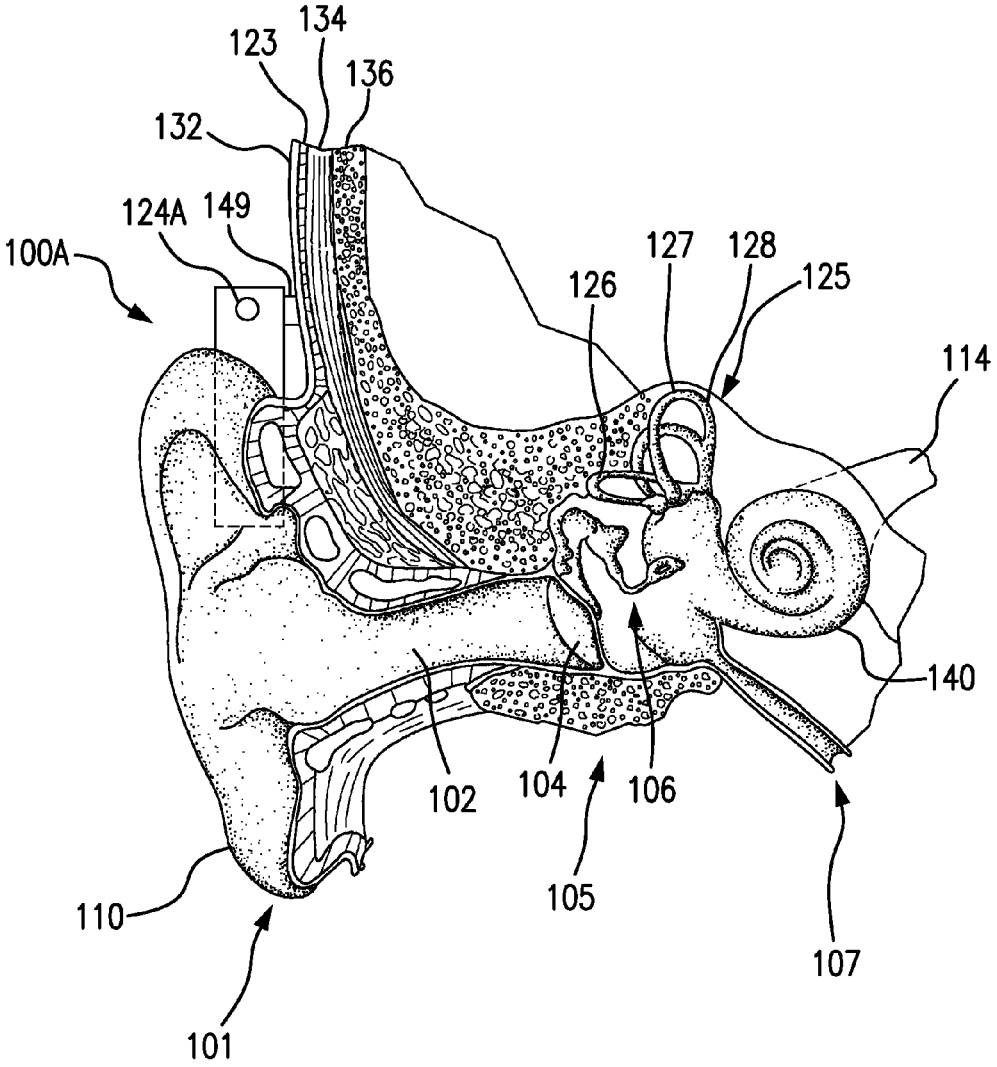
FIG. 1A is a perspective view of an exemplary bone conduction device in which at least some embodiments can be implemented.

FIG. 1A is a perspective view of a bone conduction device 100A in which embodiments may be implemented. As shown, the recipient has an outer ear 101 including ear canal 102, a middle ear 105 where the tympanic membrane 104 separates the two, and an inner ear 107. Some elements of outer ear 101, middle ear 105 and inner ear 107 are described below, followed by a description of bone conduction device 100.

FIG. 1A also illustrates the positioning of bone conduction device 100A relative to outer ear 101, middle ear 105 and inner ear 103 of a recipient of device 100. As shown, bone conduction device 100 is positioned behind outer ear 101 of the recipient and comprises a sound capture element 124A to receive sound signals. Sound capture element may comprise, for example, a microphone, telecoil, etc. Sound capture element 124A can be located, for example, on or in bone conduction device 100A, or on a cable extending from bone conduction device 100A.

Bone conduction device 100A can comprise an operationally removable component and a bone conduction implant. The operationally removable component is operationally releasably coupled to the bone conduction implant. By operationally releasably coupled, it is meant that it is releasable in such a manner that the recipient can relatively easily attach and remove the operationally removable component during normal use of the bone conduction device 100A. Such releasable coupling is accomplished via a coupling assembly of the operationally removable component and a corresponding mating apparatus of the bone conduction implant, as will be detailed below. This as contrasted with how the bone conduction implant is attached to the skull, as will also be detailed below. The operationally removable component includes a sound processor (not shown), a vibrating electromagnetic actuator and/or a vibrating piezoelectric actuator and/or other type of actuator (not shown—which are sometimes referred to herein as a species of the genus vibrator) and/or various other operational components, such as sound input device 124A. In this regard, the operationally removable component is sometimes referred to herein as a vibrator unit and/or an actuator. More particularly, sound input device 124A (e.g., a microphone) converts received sound signals into electrical signals. These electrical signals are processed by the sound processor. The sound processor generates control signals which cause the actuator to vibrate. In other words, the actuator converts the electrical signals into mechanical motion to impart vibrations to the recipient's skull.

As illustrated, the operationally removable component of the bone conduction device 100A further includes a coupling assembly 149 configured to operationally removably attach the operationally removable component to a bone conduction implant (also referred to as an anchor system and/or a fixation system) which is implanted in the recipient. With respect to FIG. 1A, coupling assembly 149 is coupled to the bone conduction implant (not shown) implanted in the recipient in a manner that is further detailed below with respect to exemplary bone conduction implants. Briefly, an exemplary bone conduction implant may include a percutaneous abutment attached to a bone fixture via a screw, the bone fixture being fixed to the recipient's skull bone 136. The abutment extends from the bone fixture which is screwed into bone 136, through muscle 134, fat 128 and skin 232 so that the coupling assembly may be attached thereto. Such a percutaneous abutment provides an attachment location for the coupling assembly that facilitates efficient transmission of mechanical force.

It is noted that while many of the details of the embodiments presented herein are described with respect to a percutaneous bone conduction device, some or all of the teachings disclosed herein may be utilized in transcutaneous bone conduction devices and/or other devices that utilize a vibrating electromagnetic actuator. For example, embodiments include active transcutaneous bone conduction systems utilizing the electromagnetic actuators disclosed herein and variations thereof where at least one active component (e.g. the electromagnetic actuator) is implanted beneath the skin. Embodiments also include passive transcutaneous bone conduction systems utilizing the electromagnetic actuators disclosed herein and variations thereof where no active component (e.g., the electromagnetic actuator) is implanted beneath the skin (it is instead located in an external device), and the implantable part is, for instance a magnetic pressure plate. Some embodiments of the passive transcutaneous bone conduction systems are configured for use where the vibrator (located in an external device) containing the electromagnetic actuator is held in place by pressing the vibrator against the skin of the recipient. In an exemplary embodiment, an implantable holding assembly is implanted in the recipient that is configured to press the bone conduction device against the skin of the recipient. In other embodiments, the vibrator is held against the skin via a magnetic coupling (magnetic material and/or magnets being implanted in the recipient and the vibrator having a magnet and/or magnetic material to complete the magnetic circuit, thereby coupling the vibrator to the recipient).

Figure 1B:
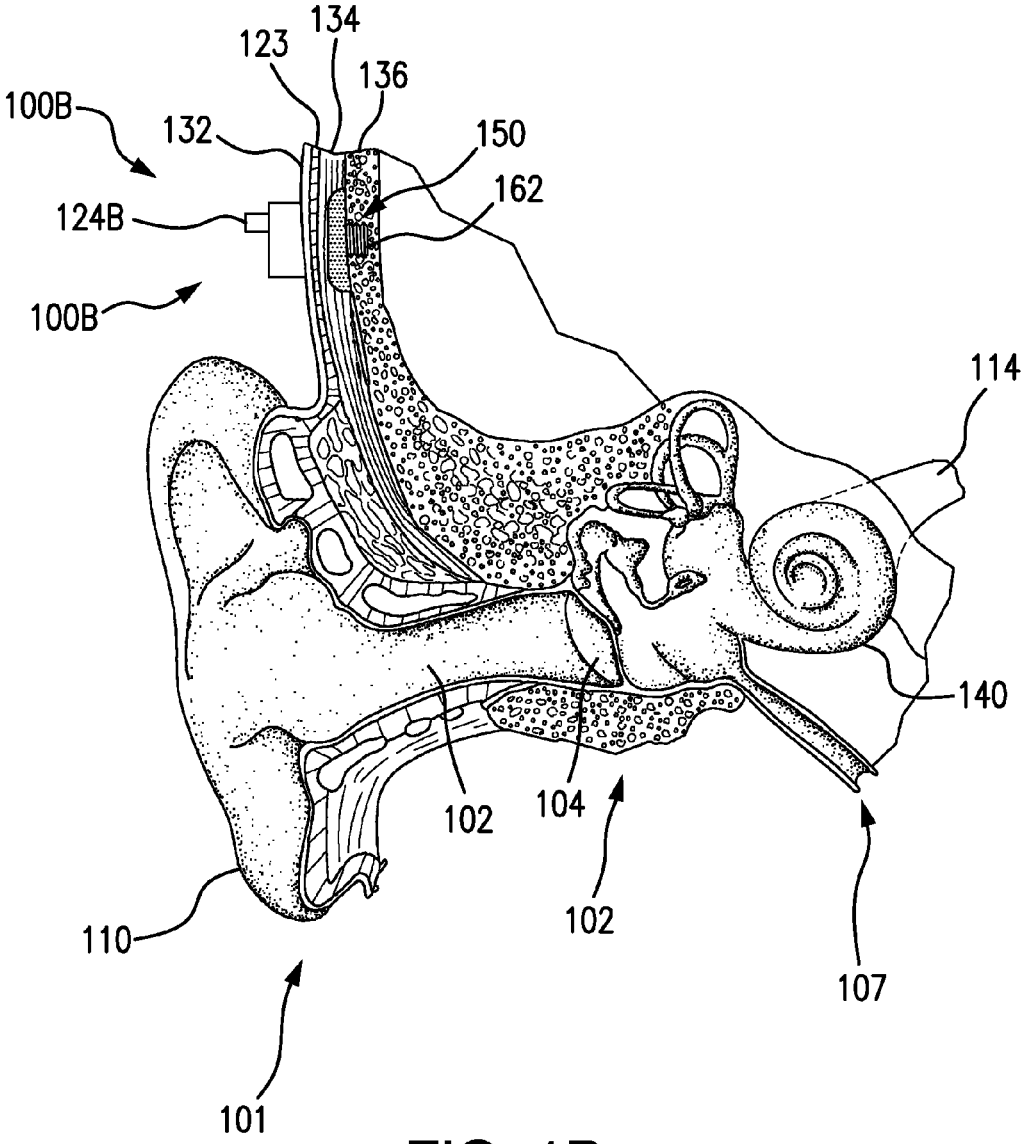
FIG. 1B is a perspective view of an alternate exemplary bone conduction device in which at least some embodiments can be implemented.

More specifically, FIG. 1B is a perspective view of a transcutaneous bone conduction device 100B in which embodiments can be implemented.

FIG. 1B also illustrates the positioning of bone conduction device 100B relative to outer ear 101, middle ear 105 and inner ear 107 of a recipient of device 100. As shown, bone conduction device 100 is positioned behind outer ear 101 of the recipient. Bone conduction device 100B comprises an external component 140B and implantable component 150. The bone conduction device 100B includes a sound capture element 124B to receive sound signals. As with sound capture element 124A, sound capture element 124B may comprise, for example, a microphone, telecoil, etc. Sound capture element 124B may be located, for example, on or in bone conduction device 100B, on a cable or tube extending from bone conduction device 100B, etc. Alternatively, sound capture element 124B may be subcutaneously implanted in the recipient, or positioned in the recipient's ear. Sound capture element 124B may also be a component that receives an electronic signal indicative of sound, such as, for example, from an external audio device. For example, sound capture element 124B may receive a sound signal in the form of an electrical signal from an MP3 player electronically connected to sound capture element 124B.

Bone conduction device 100B comprises a sound processor (not shown), an actuator (also not shown) and/or various other operational components. In operation, sound capture element 124B converts received sounds into electrical signals. These electrical signals are utilized by the sound processor to generate control signals that cause the actuator to vibrate. In other words, the actuator converts the electrical signals into mechanical vibrations for delivery to the recipient's skull.

A fixation system 162 may be used to secure implantable component 150 to skull 136. As described below, fixation system 162 may be a bone screw fixed to skull 136, and also attached to implantable component 150.

In one arrangement of FIG. 1B, bone conduction device 100B can be a passive transcutaneous bone conduction device. That is, no active components, such as the actuator, are implanted beneath the recipient's skin 132. In such an arrangement, the active actuator is located in external component 140B, and implantable component 150 includes a magnetic plate, as will be discussed in greater detail below. The magnetic plate of the implantable component 150 vibrates in response to vibration transmitted through the skin, mechanically and/or via a magnetic field, that are generated by an external magnetic plate.

In another arrangement of FIG. 1B, bone conduction device 100B can be an active transcutaneous bone conduction device where at least one active component, such as the actuator, is implanted beneath the recipient's skin 132 and is thus part of the implantable component 150. As described below, in such an arrangement, external component 140B may comprise a sound processor and transmitter, while implantable component 150 may comprise a signal receiver and/or various other electronic circuits/devices.

Figure 2A:
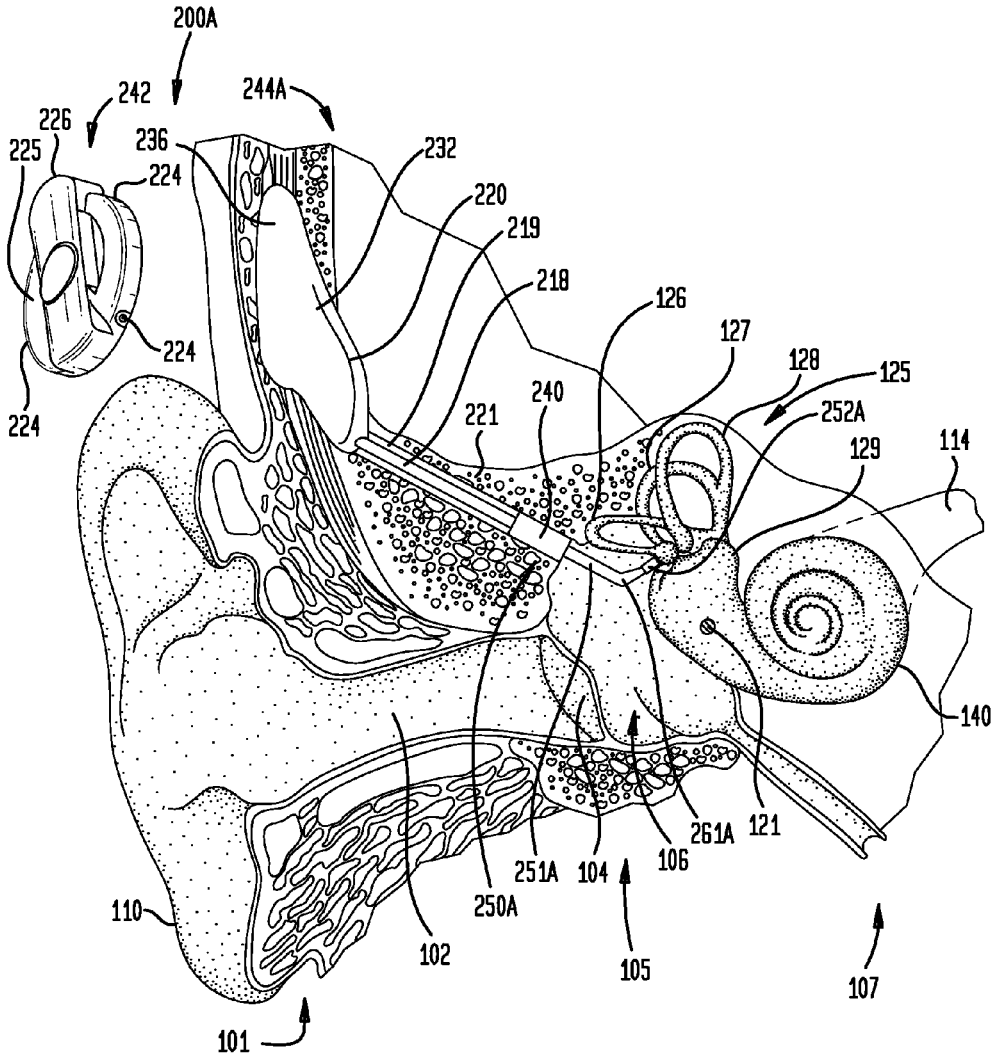
FIG. 2A is a perspective view of an exemplary direct acoustic cochlear implant (DACI) implanted in accordance with embodiments of the present invention.

FIG. 2A is a perspective view of an exemplary direct acoustic cochlear implant (DACI) 200A in accordance with embodiments of the present invention. DACI 200A comprises an external component 242 that is directly or indirectly attached to the body of the recipient, and an internal component 244A that is temporarily or permanently implanted in the recipient. External component 242 typically comprises two or more sound capture elements, such as microphones 224, for detecting sound, a sound processing unit 226, a power source (not shown), and an external transmitter unit 225. External transmitter unit 225 comprises an external coil (not shown). Sound processing unit 226 processes the output of microphones 224 and generates encoded data signals which are provided to external transmitter unit 225. For ease of illustration, sound processing unit 226 is shown detached from the recipient.

Internal component 244A comprises an internal receiver unit 232, a stimulator unit 220, and a stimulation arrangement 250A in electrical communication with stimulator unit 220 via cable 218 extending thorough artificial passageway 219 in mastoid bone 221. Internal receiver unit 232 and stimulator unit 220 are hermetically sealed within a biocompatible housing, and are sometimes collectively referred to as a stimulator/receiver unit.

In the illustrative embodiment of FIG. 2A, ossicles 106 have been explanted. However, it should be appreciated that stimulation arrangement 250A may be implanted without disturbing ossicles 106.

Stimulation arrangement 250A comprises an actuator 240, a stapes prosthesis 252A and a coupling element 251A which includes an artificial incus 261B. Actuator 240 is osseointegrated to mastoid bone 221, or more particularly, to the interior of artificial passageway 219 formed in mastoid bone 221.

In this embodiment, stimulation arrangement 250A is implanted and/or configured such that a portion of stapes prosthesis 252A abuts an opening in one of the semicircular canals 125. For example, in the illustrative embodiment, stapes prosthesis 252A abuts an opening in horizontal semicircular canal 126. In alternative embodiments, stimulation arrangement 250A is implanted such that stapes prosthesis 252A abuts an opening in posterior semicircular canal 127 or superior semicircular canal 128.

As noted above, a sound signal is received by microphone (s) 224, processed by sound processing unit 226, and transmitted as encoded data signals to internal receiver 232. Based on these received signals, stimulator unit 220 generates drive signals which cause actuation of actuator 240. The mechanical motion of actuator 240 is transferred to stapes prosthesis 252A such that a wave of fluid motion is generated in horizontal semicircular canal 126. Because, vestibule 129 provides fluid communication between the semicircular canals 125 and the median canal, the wave of fluid motion continues into median canal, thereby activating the hair cells of the organ of Corti. Activation of the hair cells causes appropriate nerve impulses to be generated and transferred through the spiral ganglion cells (not shown) and auditory nerve 114 to cause a hearing percept in the brain.

Figure 2B:
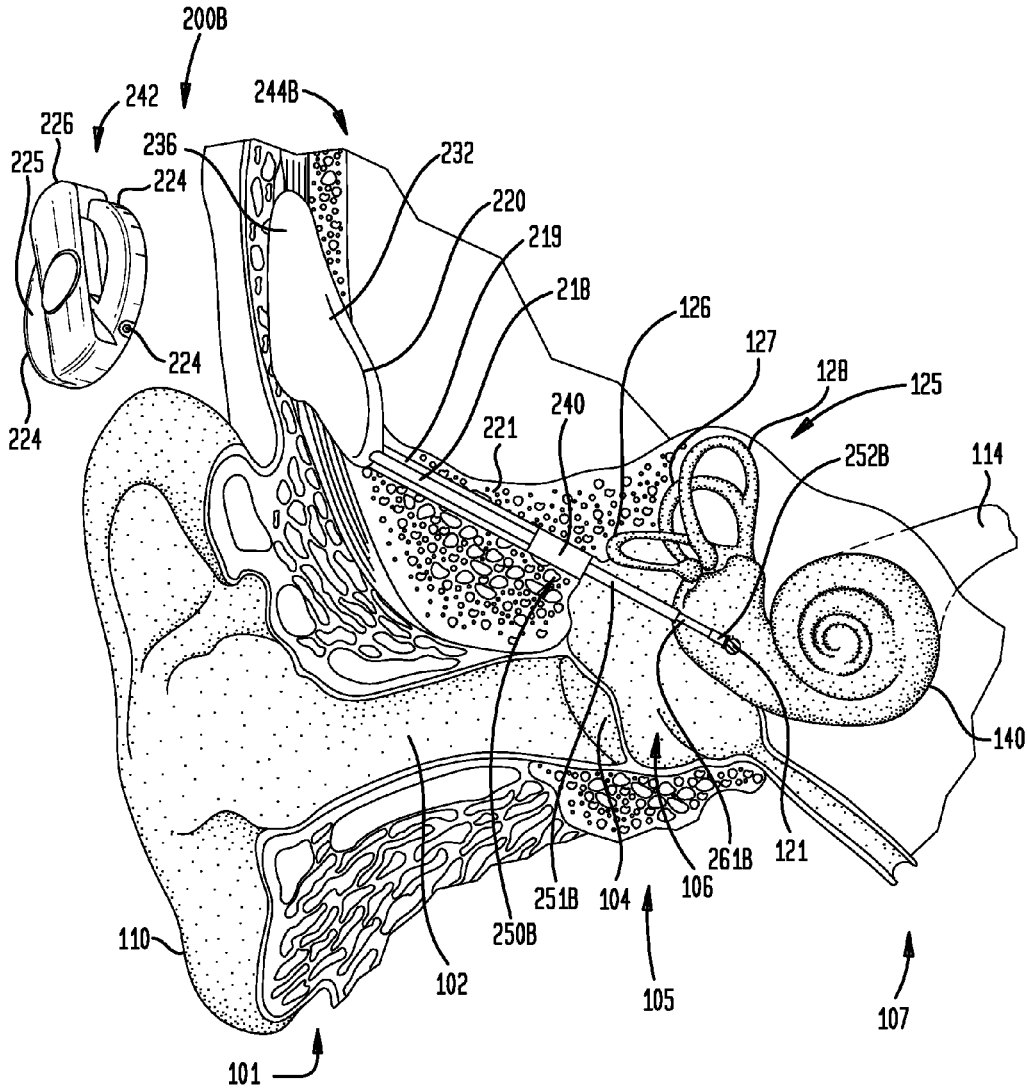
FIG. 2B is a perspective view of an exemplary DACI implanted in accordance with an embodiment of the present invention.

FIG. 2B is a perspective view of another type of DACI 200B in accordance with an embodiment of the present invention. DACI 200B comprises external component 242 and an internal component 244B.

Stimulation arrangement 250B comprises actuator 240, a stapes prosthesis 252B and a coupling element 251B which includes artificial incus 261B which couples the actuator to the stapes prosthesis. In this embodiment, stimulation arrangement 250B is implanted and/or configured such that a portion of stapes prosthesis 252B abuts round window 121 of cochlea 140.

Figure 2C:
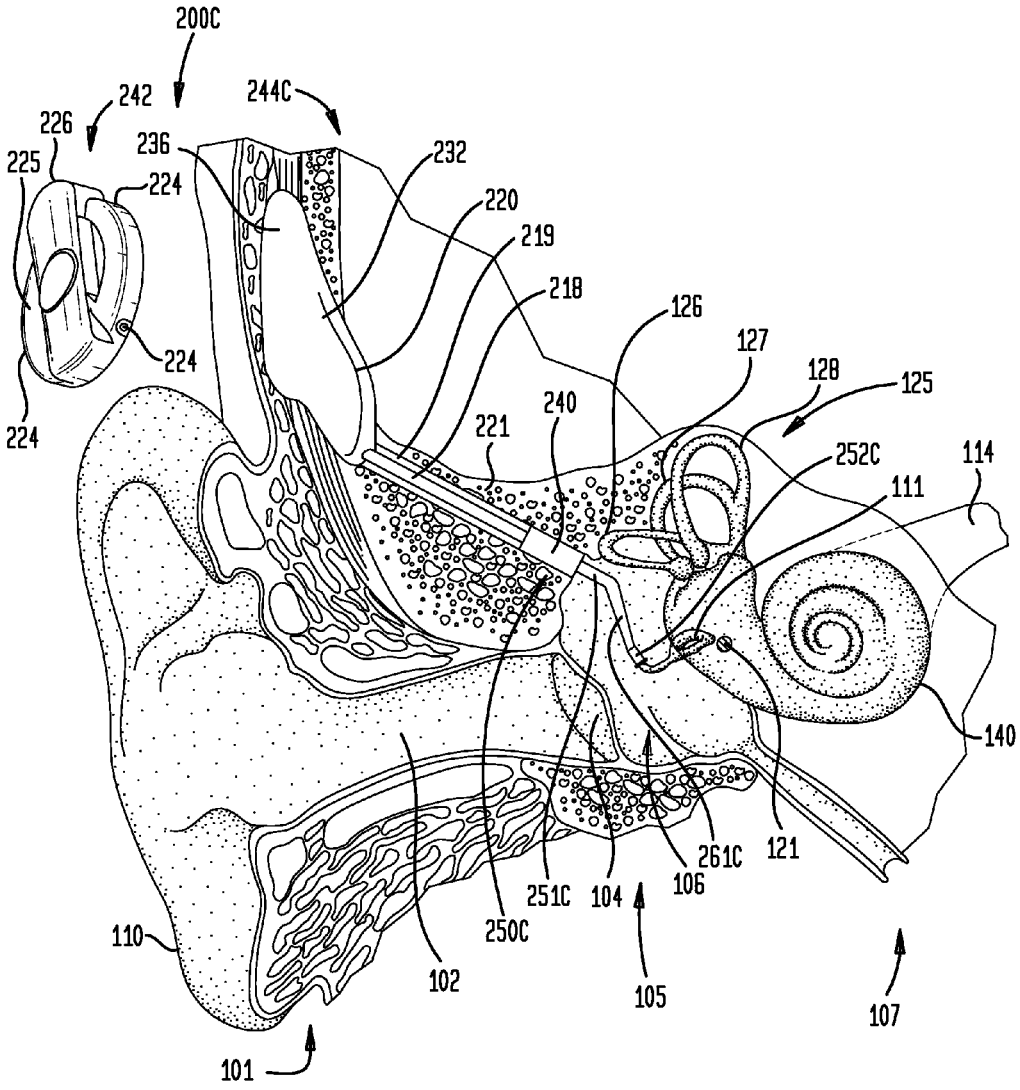
FIG. 2C is a perspective view of an exemplary DACI implanted in accordance with an embodiment of the present invention.

The embodiments of FIGS. 2A and 2B are exemplary embodiments of a middle ear implant that provides mechanical stimulation directly to cochlea 140. Other types of middle ear implants provide mechanical stimulation to middle ear 105. For example, middle ear implants may provide mechanical stimulation to a bone of ossicles 106, such to incus 109 or stapes 111. FIG. 2C depicts an exemplary embodiment of a middle ear implant 200C having a stimulation arrangement 250C comprising actuator 240 and a coupling element 251C. Coupling element 251C includes a stapes prosthesis 252C and an artificial incus 261C which couples the actuator to the stapes prosthesis. In this embodiment, stapes prosthesis 252C abuts stapes 111.

The bone conduction devices 100A and 100B include a component that moves in a reciprocating manner to evoke a hearing percept. The DACIs, 200B and 200C also include a component that moves in a reciprocating manner evoke a hearing percept. The movement of these components results in the creation of vibrational energy where at least a portion of which is ultimately transmitted to the sound capture element (s) of the hearing prosthesis. In the case of the active transcutaneous bone conduction device 100B and DACIs 200A, 200B, 200C, in at least some scenarios of use, all or at least a significant amount of the vibrational energy transmitted to the sound capture device from the aforementioned component is conducted via the skin, muscle and fat of the recipient to reach the operationally removable component/external component and then to the sound capture element(s). In the case of the bone conduction device 100A and the passive transcutaneous bone conduction device 100B, in at least some scenarios of use, all or at least a significant amount of the vibrational energy that is transmitted to the sound capture device is conducted via the unit (the operationally removable component/the external component) that contains or otherwise supports the component that moves in a reciprocating manner to the sound capture element(s) (e.g., because that unit also contains or otherwise supports the sound capture element(s)). In some embodiments of these hearing prostheses, other transmission routs exist (e.g., through the air, etc.) and the transmission route can be a combination thereof. Regardless of the transmission route, energy originating from operational movement of the hearing prostheses to evoke a hearing percept that impinges upon the sound capture device, such that the output of the sound capture device is influenced by the energy, is referred to herein as physical feedback.

Figure 3:
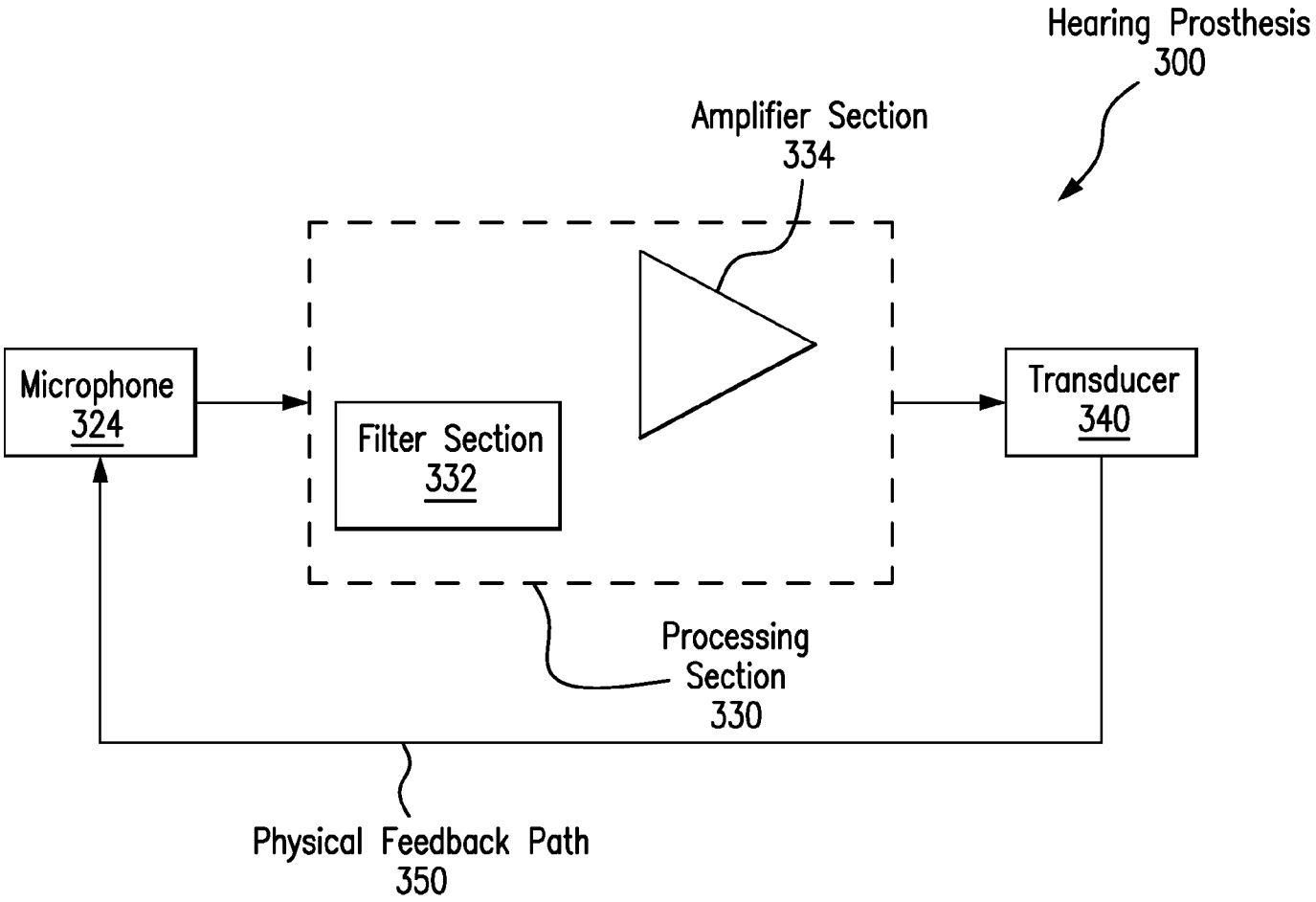
FIG. 3 is a functional diagram of an exemplary hearing prosthesis.

In broad conceptual terms, the above hearing prostheses and other types of hearing prostheses (e.g., conventional hearing aids, which the teachings herein and/or variations thereof are also applicable), operate on the principle illustrated in FIG. 3, with respect to hearing prosthesis 300. Specifically, sound is captured via microphone 324 and is transduced into an electrical signal that is delivered to processing section 330. Processing section 330 includes various elements and performs various functions. However, in the broadest sense, the processing section 330 includes a filter section 332, where, in at least some embodiments, includes is a series of filters, and an amplifier section 334, which amplifies the output of the processing section 330. (Note that in some instances, the signal from microphone 324 is amplified prior to receipt by filter section 332, and in other instances the application occurs after filter section 332 filters the signal from microphone 324. In some instances, amplification occurs both before and after the filter section 332 performs its function.) Processing section 330 can divide the signal received from microphone 324 into various frequency components and processes the different frequency components in different manners. In an exemplary embodiment, some frequency components are amplified more than other frequency components. The output of processing section 330 is one or more signals that are delivered to transducer 340, which converts the output to mechanical energy (or, in the case of a conventional hearing aid, acoustic energy) that evokes a hearing percept.

FIG. 3 further functionally depicts the physical feedback path 350 of the hearing prostheses. In some embodiments, the amount of feedback received by microphone 324, or, more accurately, the amount of influence of the feedback on the output of the microphone 324 limits the amount of gain that the processing section 330 applies to the received signal from the microphone 324, in totality and/or on a frequency by frequency basis. The amount of influence translates to a so-called gain margin of the processing section 330, which correlates to a frequency dependent maximum gain that is deemed to provide a utilitarian hearing percept evoking experience without subjecting the recipient to an unacceptable amount/level of feedback influenced hearing percepts, which includes none at all (hereinafter, the "feedback path gain margin"—note that this term as used is a physical characteristic of the individual prostheses that exists irrespective of whether its value is obtained). Put another way, the physical feedback influences, or, more specifically, places limits on the highest value that can be set for the gain margin of the processing section 330. In at least some embodiments, the greater the influence of feedback on the output of the microphone 324, the lower the gain margin of the processing section 330. All things being equal, in at least some embodiments, higher values of gain margin have more utilitarian value than lower values of gain margin.

Accordingly, embodiments of at least some of the hearing prostheses detailed herein and/or variations thereof include a feature that enables the gain margin of the prosthesis to be set or otherwise adjusted. Some such embodiments include a hearing prosthesis that enables the gain margin to be set to a setting that is individualized to a specific prosthesis/user combination, for example, based on data obtained while the hearing prosthesis is implanted or otherwise prosthetically attached (e.g., as in the case of a conventional hearing aid or a behind the ear vibrator) as will be detailed below.

Figure 4:
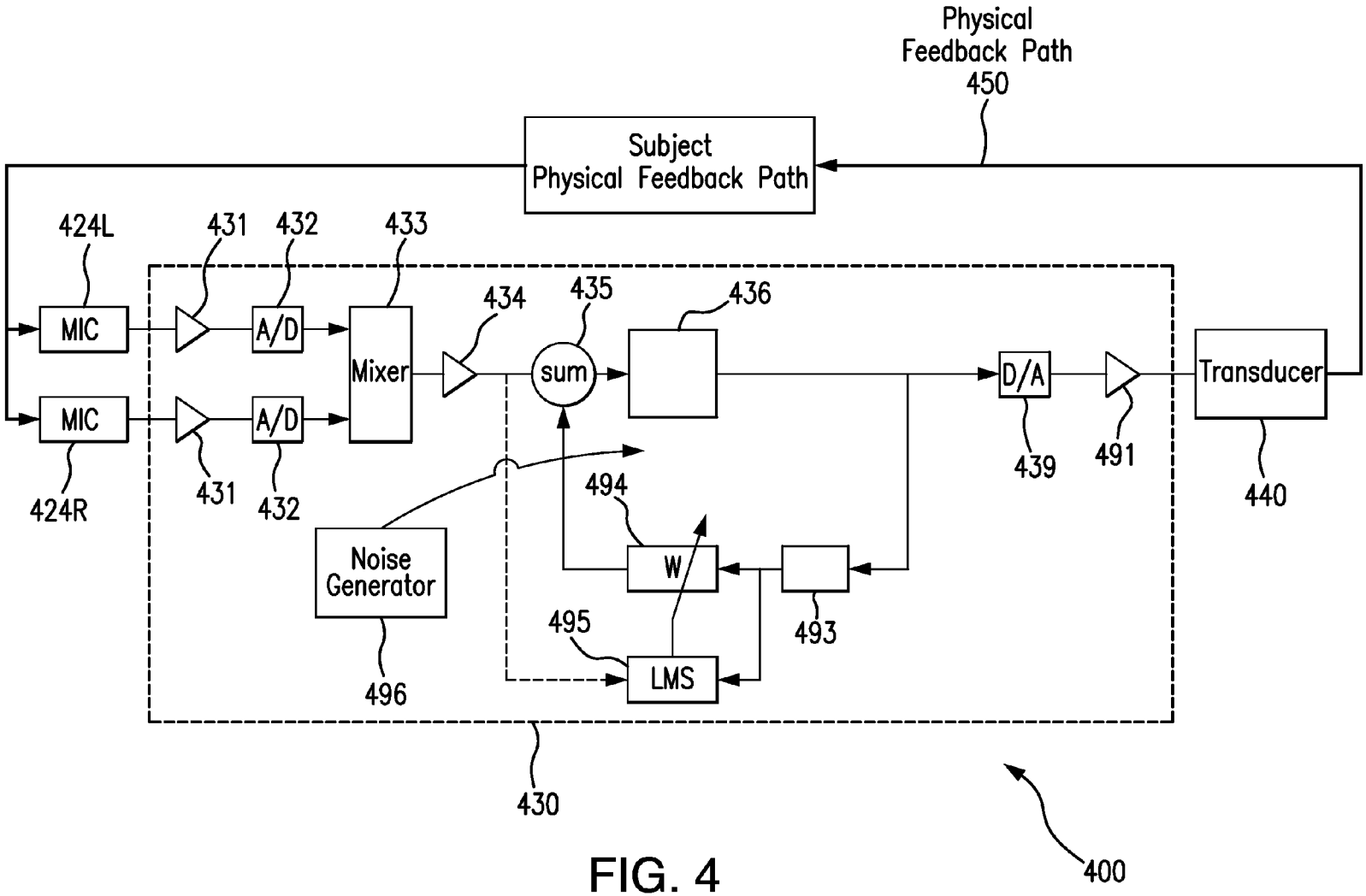
FIG. 4 is a functional diagraph depicting additional details of the hearing prosthesis of FIG. 3.

FIG. 4 functionally depicts an exemplary hearing prosthesis 400 and a physical feedback path of an exemplary hearing prosthesis corresponding to that of FIG. 3 (in greater detail), having a configuration such that the feedback path gain margin of the hearing prostheses can be measured or otherwise estimated while attached to the recipient. More particularly, microphones 424L and 424R correspond to microphone 324 of FIG. 3, processing section 430 corresponds to processing section 330 of FIG. 3, and transducer 440 corresponds to transducer 340 of FIG. 3. Physical feedback path 450 corresponds to path 350 of FIG. 3. Still referring to FIG. 4, as can be seen, the processing section 430 includes amplifiers 431, analog to digital converters 432, mixer 433, amplifier 434, summation device 435, gain equalizer 436, digital to analog converter 439 and amplifier 491. Processing section 430 further includes a feedback cancellation system that includes a pre-filter 493, filter system 494 having adjustable filter coefficients which is in communication with least mean squares block 495, the latter two elements collectively forming an adaptive system. In an exemplary embodiment, the least means squares filter system is a signed least mean squares filtered system. In an alternative embodiment, a normalized least means squares filter system and/or an ordinary least squares filter system can be utilized. Systems utilizing an algorithm based on a t-distribution and/or an M-estimation and/or an outlier detection adaptation system can be utilized in some embodiments. Any device, system or method that can be utilized to determine the filter coefficients or otherwise control the filter systems to practice the embodiments detailed herein and/or variations thereof can be utilized in a least some embodiments.

As can be seen, the processing section 430 further includes a noise generator 496 (although in alternate embodiments, the noise generator can be remote from the hearing prosthesis), which can be variously placed into and taken out of signal communication with the other components of the processing section 430, so as to input a noise into the system that has utilitarian value as will be described below.

Figure 5A:
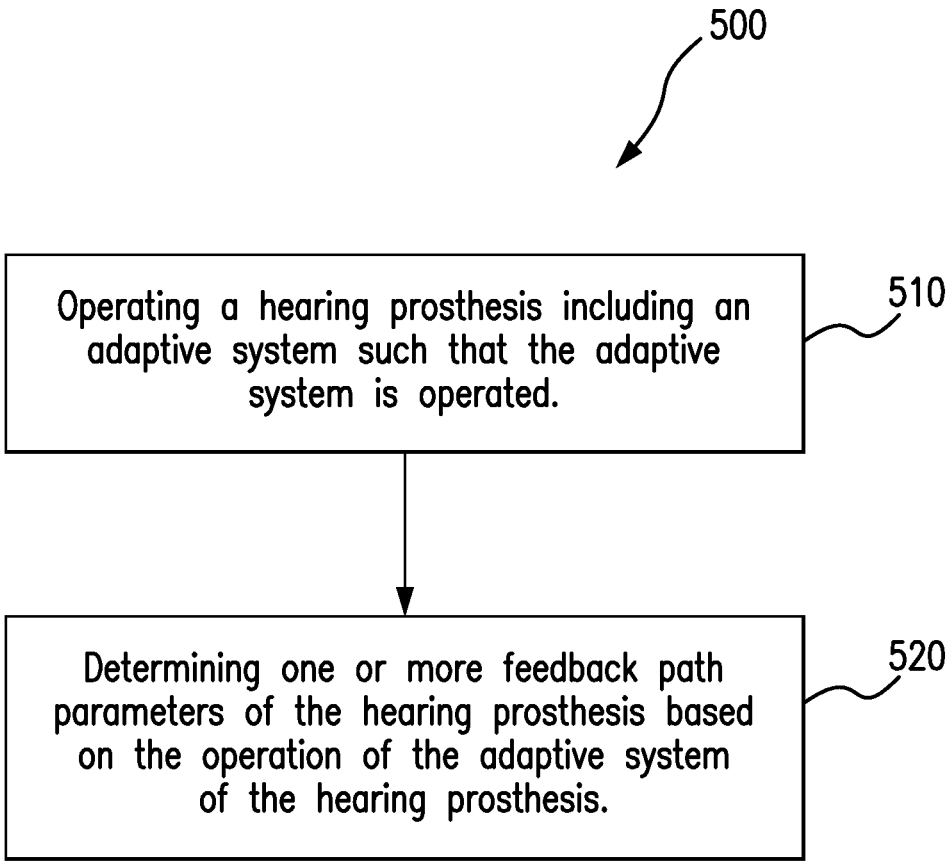
FIG. 5A is a flowchart for an exemplary method.

FIG. 5 presents a flowchart representing an exemplary method 500 according to an exemplary embodiment. More particularly, method 500 includes action 510 which entails operating a hearing prosthesis including an adaptive system such that the adaptive system is operated. Method 500 further includes method action 520, which entails determining one or more feedback path parameters of the hearing prosthesis based on the operation of the adaptive system of the hearing prosthesis. Additional details and variations of the method 500 will now be described.

In an exemplary embodiment, the adaptive system is a feedback management system, or at least is a part of a feedback management system. Accordingly, in an exemplary embodiment, action 510 entails operating a hearing prosthesis including a feedback management system such that the feedback management system is operated, and method action 520 entails determining one or more feedback path parameters of the hearing prosthesis based on the operation of the feedback management system of the hearing prosthesis.

It is noted that reference to a feedback management system herein includes a feedback management system that utilizes an adaptive system of another system of the hearing prosthesis to operate or otherwise manage feedback. For example, a feedback management system can utilize an adaptive system that is part of an echo cancellation system or a beamforming system, etc. Accordingly, an operation of an adaptive system of a feedback management system of the hearing prosthesis can correspond to operation of an adaptive system that is part of an echo cancellation system if the adaptive system is used by the feedback management system, at least to manage feedback.

In an exemplary embodiment, method 500 and/or the other methods detailed herein and/or variations thereof includes the action of attaching the hearing prostheses 400 to a recipient in a manner generally the same as (including the same as) that which would be the case during normal use thereof. (It is noted that in at least some embodiments, every method action detailed herein and/or variation thereof is practiced while the hearing prosthesis is implanted or otherwise prosthetically attached to the recipient, and, accordingly, any of the devices and systems and apparatuses detailed herein and/or variations thereof can be utilized with the hearing prosthesis so prosthetically attached). In an exemplary embodiment, an audiologist initiates a test routine associated with the hearing prostheses 400 that, among other things, enables the determination of one or more feedback path parameters based on the operation of the adaptive system of the feedback management system (e.g., determination of the feedback path gain margin). That is, it enables method action 520 to be executed. An exemplary test routine can include placing the noise generator 496 into signal communication with the other components of the processing section 430. The noise generator 496 generates noise, which ultimately causes transducer 440 to transducer energy (e.g., vibrate in the case of a bone conduction device) to evoke a hearing percept corresponding to the noise generated by the noise generator 496 (the aforementioned actions being an example of method action 510). In at least some instances, feedback through the physical feedback path 450 occurs.

In an exemplary embodiment, the one or more feedback path parameters determined in method action 520 include a feedback path gain margin. The feedback path gain margin can be determined based on data based on the adaptive part (adaptive system) of the feedback management system of the hearing prosthesis. More particularly, method action 520 can entail determining the one or more feedback path parameters based on data related to the adaptive filter coefficients of filters of the feedback management system. In this regard, in an exemplary embodiment, the filters of the feedback cancellation system represent the physical feedback path (e.g., physical feedback path 450 with respect to FIG. 4). That is, as the feedback path 450 changes, the feedback cancellation system of the hearing prosthesis 400 automatically adjusts to compensate for this changed feedback path. This adjustment is typically in the form of real-time changes to the filter coefficients of filter system 494. Accordingly, an exemplary embodiment entails reading these filter coefficients, and based on the readings, determining the feedback path gain margin of the hearing prosthesis.

In an exemplary embodiment, the action of determining the one or more feedback path parameters (method action 520) includes determining such based on data based on one or more values of the filter coefficients. That is, the determination is based on the actual value(s) of the filter coefficients are utilized in the determination. This means that the value(s) can be read from the filters and/or that data from the LMS block can be read (which is indicative of the values of the filter coefficients, because the filter coefficients are adjusted based on the output of the LMS block). It is noted that in some embodiments, alternatively and/or in addition to the filter coefficients and/or the LMS block, output of any component of the feedback management system can be utilized to practice the teachings detailed herein and/or variations thereof. Moreover, in at least some embodiments, output of any component of the hearing prosthesis and/or a system that interfaces therewith that is indicative of the performance of the feedback management system such that one or more feedback path parameters of the hearing prosthesis can be determined can be utilized in at least some embodiments.

It is noted that in some embodiments, alternatively and/or in addition to utilizing actual values of the filter coefficients, data related to the adaptive filter coefficients corresponds to data related to a change in the adaptive filter coefficients from one or more previous values of the adaptive filter coefficients. That is, the magnitude (e.g., change of 5%) and/or direction of change (e.g., decrease) of the filter coefficients can be utilized. Any parameter indicative of a change in the adaptive filter coefficients can be utilized in some embodiments. Such can have utility in exemplary embodiments where the filter coefficients are normalized. It is noted that the aforementioned alternative embodiment(s) is also applicable to the output of the least mean squares block, and/or any other output of any component of the feedback management system that can be utilized to practice the teachings detailed herein and/or variations thereof, and/or the output of the aforementioned exemplary system that interfaces with the hearing prosthesis that is indicative of the performance of the feedback management system such that one or more feedback path parameters of the hearing prosthesis can be determined.

Accordingly, an exemplary embodiment includes defining a feedback path based on adaptation of a feedback algorithm of a feedback management system. In an exemplary embodiment, this feedback path is defined without reading or otherwise analyzing the output signal from the microphones of the hearing prosthesis (other than utilizing that output as an input to the feedback management system). That is, an exemplary embodiment includes executing method action 520 without reading or otherwise analyzing the output signal from the microphones of the hearing prosthesis/based solely on the adaptation of the feedback algorithm of the feedback management system. Along these lines, the action of determining the one or more feedback path parameters (method action 520) can include determining the one or more feedback path parameters based on data related to an output of a sound capture system (e.g., the output of microphones 424L and 424R, after the output has been mixed by mixer 433 and amplified by amplifier 434, although in other embodiments the output can be obtained upstream of one or more of these components) related to an input of an output transducer of the hearing prosthesis (e.g., the inputs directed to D/A converter 439, which leads to amplifier 491 and transducer 440 (the output transducer)—this being the signal that is directed to the adaptive filter system 493, although in other embodiments, the input can be obtained downstream of one or more of these components. In some embodiments, any data that is utilized to operate the feedback management system can be utilized in some embodiments to practice method action 520.

Still keeping with the concept of the output of the sound capture system and the input to the output transducer being used to practice method action 520, in an exemplary embodiment, one or more of the feedback path parameters is determined based on a statistical manipulation of the data related to an output of the sound capture system and the data related to the input of the output transducer of the hearing prosthesis. In an exemplary embodiment, such can have utility in that coherence data can be collected or otherwise utilized to determine the feedback path parameters and/or adjust a functionality of the hearing prosthesis. (Application of such data will be detailed below.) For example, standard deviation data from the aforementioned input and output (corresponding to the inputs into the feedback management system, at least in some exemplary embodiments) can be utilized to set the gain margin of the hearing prosthesis. Broadly speaking, the average (mean, median and/or in at least some instances, mode) of various readings (samples) of the input and the output and/or the components of the feedback management system at different temporal locations can be utilized to execute method action 520. This can have utility in that extraneous data, for example, can be smoothed out of and/or otherwise eliminated from the data utilized to determine the one or more feedback path parameters. In at least some embodiments, the statistical manipulation of the data is executed via a stochastic gradient decent method, such as, by way of example only and not by way of limitation, a least mean squares manipulation of the data (the data related to the output of the sound capture system and the inputs of the output transducer).

An exemplary method further includes applying criteria that is indicative of a sufficiently stable feedback path (sufficiently stable measurement results) to evaluate whether or not the determined one or more feedback path parameters is stable. For example, with respect to the just-detailed embodiment, if the least mean squares data and/or the filter coefficients do not change over time/only change a relatively small amount over time, it is indicative of a feedback path that is not changing over time (or at least not significantly changing over time such that the changes influence in a meaningful way the occurrence of feedback). That is, it can be assumed that the feedback path is stable, and that the data has sufficient utility to determine one or more feedback path parameters based on that data. Put another way, it can be assumed that the determined feedback path parameters have sufficient validity such that they have sufficient utility to be utilized to adjust a functional parameter of the hearing prosthesis (e.g., set the gain margin of the hearing prosthesis based on the determined feedback path parameter(s), set a beamforming feature parameter based on the determined feedback path parameter (s), etc.). Further, an exemplary method entails developing criteria for determining when the determined feedback path parameters have sufficient utility. That is, an exemplary embodiment can include a method of utilizing data obtained as a result of the operation of the feedback management system of the hearing prosthesis to develop a data set. This can be done with respect to an individual recipient and/or with respect to a sampling of recipients. This developed data set can be used to determine when the determined feedback parameters have sufficient utility during, for example, a fitting session, etc.

Figure 5B:
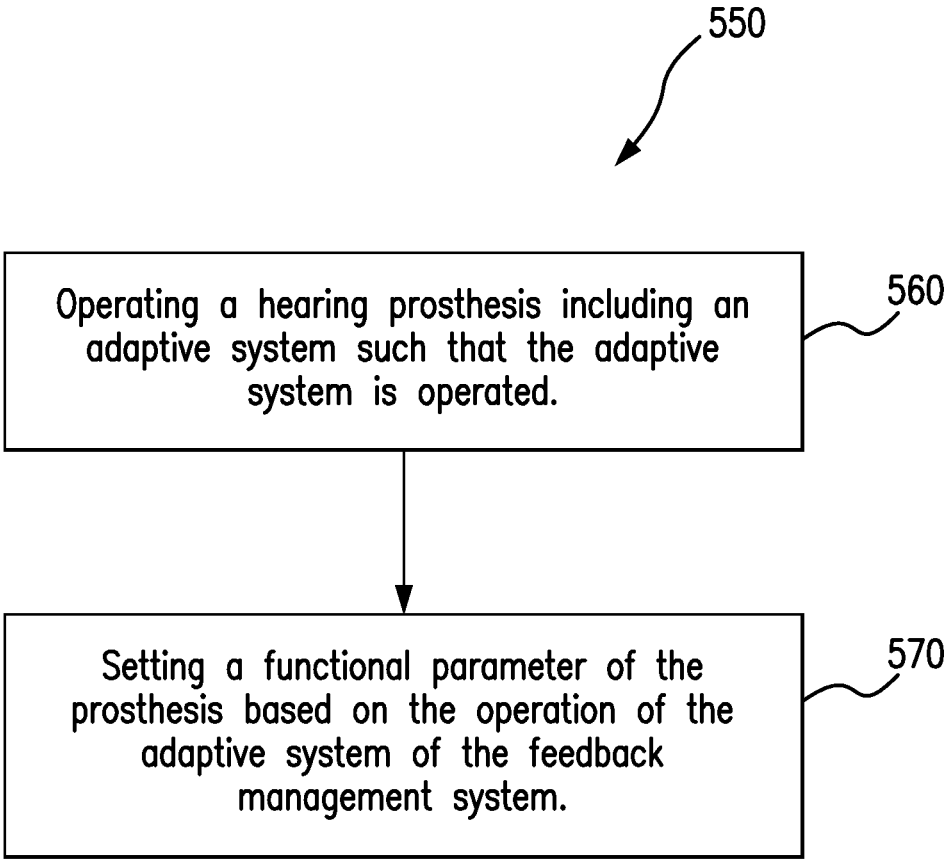
FIG. 5B is a flowchart for another exemplary method.

Referring now to FIG. 5B, an exemplary embodiment includes an exemplary method 550 which includes method action 560, which entails operating a hearing prosthesis such that the adaptive system of the feedback management system thereof is operated. In this regard, method action 560 can be the same as method action 510 detailed above. Method 550 further includes method action 570, which entails setting a functional parameter, such as the gain margin, of the hearing prosthesis based on the operation of the adaptive system of the feedback management system thereof. With respect to setting the gain margin, there is utility in setting the gain margin of the hearing prosthesis based on the determined feedback path parameter, although it is noted that method 550 can be executed without an actual determination of a feedback path parameter (e.g., the raw data and/or modified data obtained as a result of method action 560 can be utilized to implement method action 570).

It is noted that instead of increasing or decreasing the gain margin, the gain margin to which the hearing prosthesis is set can be set can be determined via an analytical method. For example, an algorithm can be utilized to estimate where the gain margin should be set based on the operation of the adaptive system of the feedback management system. Any method that can be utilized to determine the gain margin to which the hearing prosthesis is to be set to avoid or otherwise reduce the likelihood of feedback can be utilized in some embodiments, just as any device or system to do so is included in at least some embodiments.

Still further, an exemplary embodiment includes a method of setting a gain margin of the hearing prosthesis based on a determination that the collected readings (samples) indicates coherence of the readings (samples). More particularly, an exemplary method can include collecting samples at different temporal locations of parameters related to the feedback management system of the hearing prosthesis. In an exemplary embodiment, the parameters can include data related to the filter coefficients as detailed herein and/or variations thereof. These readings/samples can be statistically analyzed and, upon a determination that the statistical analysis indicates coherence, the gain margin can be set based on the collected samples (readings.)

In an exemplary embodiment, utilizing a computer or other equivalent system or alternate system configured to provide corresponding utilitarian functionality, including fitting software or the like, placed into signal communication with the prostheses 400, the filter coefficients are read from filter system 494 and/or the output of the least mean squares block 495 is read, and/or data based on that data is read. From this data, one or more feedback path parameters of the hearing prosthesis based on the operation of the adaptive system of the feedback management system (or of another system in some alternate embodiments) thereof can be determined (method action 520). This process can be repeated (including, optionally, additional steps and/or fewer steps) where the gain of the processing section 430 is increased and/or decreased. That is, the process can be repeated in an iterative manner. In an exemplary embodiment, from these readings and/or from the recipient interrogation, the feedback path gain margin can be obtained.

More particularly, in an exemplary embodiment, method 550 further includes the action of evaluating the filter coefficients of the adaptive filter system and/or the output of the least mean squares block, including utilizing any of the statistical evaluation methods detailed herein and/or variations thereof, to determine whether feedback is occurring at a given gain margin of the hearing prosthesis. A low value (including a zero value) of the filter coefficients and/or a low value (including a zero value) of the least mean squares block is indicative of little to no feedback. Thus, in an exemplary embodiment, the gain margin is increased in an iterative manner while the noise generator generates noise (and/or noise is inputted remotely into the hearing prosthesis) until these values are no longer low. The gain margin of the hearing prosthesis is then set to a value corresponding to that just before the values changed and/or that just before the values changed plus a safety factor. In an alternative embodiment, the gain margin is decreased in an iterative manner while the noise generator generates noise (and/or noise is inputted remotely into the hearing prosthesis) until these values correspond to low values (at least providing that the recipient is agreeable to such a regime). The gain margin of the hearing prosthesis is then set to a value corresponding to that where the values changed and/or that where the values changed plus a safety factor.

In an alternate embodiment, which can be separate from the processes just described and/or can be utilized in combination with the process just described, method action 510 and/or 560 entails generating sound remote from the hearing prostheses 400, such that it is captured by the microphones 424R and 424R (instead of noise generated by the noise generator 496 if used without combination with the process just described). In such an embodiment, output from the microphones 424R and 424L resulting from the sound that is captured thereby is ultimately utilized to actuate the transducer 440 to evoke a hearing percept (or at least a vibration of such caliber that should evoke a hearing percept). More particularly, this ultimately causes transducer 440 to transducer energy (e.g., vibrate in the case of a bone conduction device) to evoke a hearing percept corresponding to the sound captured by the microphones 424R and 424L (the aforementioned actions corresponding to method action 510). In at least some instances, feedback through the physical feedback path 450 occurs. A computer or other equivalent system or alternate system configured to provide corresponding utilitarian functionality, including fitting software or the like, placed into signal communication with the prostheses 400, can be utilized to read the filter coefficients from filter system 494 and/or to read the output of the least mean squares block 495, and/or read data based on that data. From this data, the feedback path parameter of the hearing prosthesis based on the operation of the feedback management system thereof can be determined (method action 520).

In an exemplary embodiment, noise generator 496 can output (alternatively or in addition to this a remote system can input into the hearing prosthesis) one or more of white noise, a maximum length sequence (MLS) a stepped sine wave, a chirp and/or any other type of noise that can enable the feedback management system of a hearing prosthesis to be operated in a manner sufficient such that one or more feedback path parameters of the hearing prosthesis can be determined based on the operation of the feedback management system. Alternatively or in addition to this, in an exemplary embodiment, one or more or all of these types of noises are fed into the microphones 424L and/or 424R so as to enable the feedback management system to be so operated. Indeed, in an exemplary embodiment, any type of stimuli that can be utilized to enable method action 520 to be practice can be utilized in at least some embodiments.

It is noted that in an alternate embodiment, an audiologist might not be involved in the execution of method 500 and/or method 550. Indeed, in some embodiments, a hearing prosthesis can be configured to execute at least one of method actions 510, 520, 560 and/or 570 autonomously (albeit with, perhaps, the aid of the recipient). It is further noted that any impulse response related to the feedback management system that can enable the feedback path gain margin to be obtained can be utilized in at least some embodiments. It is further noted that while the above processes detail that the output from the LMS block and/or the coefficients of the filter system 494 are utilized, in other embodiments, any data associated with a feedback algorithm of the hearing prosthesis can be utilized to obtain feedback path gain margin.

For example, in an exemplary embodiment, alternatively and/or in addition to the utilization of data related to the adaptive filter coefficients (whether the data be from the filters themselves or from the LMS block), one or more feedback path parameters of the hearing prosthesis can be determined based on a feedback algorithm gain reduction feature and/or performance thereof. In this regard, hearing prosthesis use scenarios can exist where the feedback cancellation features of the feedback management system of the hearing prosthesis are not enough to prevent, by itself, the occurrence of feedback. In some embodiments, an override feature can be implemented that suppresses the gain of the processing section 430 to avoid the occurrence of feedback. In an exemplary embodiment, data indicative of the amplitude of the filter coefficients of the feedback management system during operation is obtained (e.g. the filter coefficients are coefficients are monitored (read), either directly or indirectly, or a proxy is utilized, such as the LMS block, etc.), and based on the amplitude of the filter coefficients, amplitude of the output of the processing section 430 is adjusted. In an exemplary embodiment, the gain margin of the hearing prosthesis is set based on the aforementioned feedback algorithm gain reduction feature performance, and thus the gain margin is set based on the operation of a feedback management system of the hearing prosthesis.

As detailed above, in some embodiments, there is utility in setting the gain margin the hearing prosthesis based on the determined feedback path parameter. Accordingly, the gain margin can be set based on operation of the feedback management system. Additional utility of the determined feedback path parameter(s) (in broader terms, additional utility of utilizing the operation of the feedback management system) can include a method that includes setting the pre-filters 493 based thereon. Additional utility of the determined feedback path parameter(s)/utilizing the operation of the feedback management system can include developing a correlation depth based on the determined feedback path parameter. Accordingly, an exemplary embodiment includes a method of developing a correlation depth based on the determined feedback path parameter (based on an operation of the feedback management system). More particularly, the adaptive feedback management system functions, in at least some embodiments, based on a principle where the system looks for similarities and/or differences in the data resulting from operation of the feedback management system to adapt the system. In basic terms, the adaptive feedback management system can have a function that varies the timeframe by which the system looks look for the similarities/differences. In some exemplary embodiments, the feedback management system can have heightened utilitarian value with respect to heightened speed of filter coefficient update. In some embodiments, the less time between filter updates, the more utilitarian value. However, in some embodiments, there is utility in updating the filter coefficients at a rate that is not so fast that meaningful differences in the data cannot be identified in a manner that yield utilitarian results. That is, the period should not be so short/the update occurrence is so rapid that audible artifacts can occur. Thus, an exemplary embodiment includes setting the period to have a minimum update time that audible artifacts effectively do not occur.

Accordingly, in an exemplary embodiment, a speed of adaptation of the adaptive feedback algorithm of the feedback management system is set based on the correlation depth. It is noted that in some alternate embodiments, the correlation depth need not be determined. Thus, in an exemplary embodiment, the speed of adaptation of the adaptive feedback algorithm is set based on the determined feedback path parameters and/or the operation of the feedback management system. Thus, an exemplary embodiment includes a method of varying the filter coefficient update frequency based on the determined feedback path parameters (or based on operation of the feedback management system). In an exemplary embodiment, the filter coefficients are updated every millisecond. In an alternate embodiment, the filter coefficients are updated every 10 ms. Thus, in an embodiment, there is a method of varying the filter coefficient update frequency to values within a range of about 1 ms to about 10 ms based on the operation of the feedback management system/based on the determined feedback path parameters. It is noted that in an exemplary embodiment, this can be frequency dependent. For example, filters associated with certain frequencies can have an update frequency that is different than filters associated with other frequencies. In an exemplary embodiment, the method entails varying the filter coefficients specific filters corresponding to specific frequencies at different update frequencies based on the frequency of the signals input into the feedback management systems.

The feedback management system (or adaptive system thereof and/or any other utilitarian adaptive system) can be utilized, in some embodiments, to identify a latency that should be added or otherwise used by the feedback management system, where the latency is associated with changes in the coefficients of the adaptive filters (including output of the LMS block), at least for a given feedback path. That is, there will be some delay between the temporal location of an event that later (due to the delay) causes the filter coefficients to change and the subsequent temporal location at which the filter coefficients actually change. This data can be utilized to fine tune the feedback management system. Accordingly in an in an exemplary embodiment, there is a method that entails operating the adaptive system of the feedback management system or other applicable system, and determining a latency of the changes in the filter coefficients of the adaptive filters with respect to a filter coefficient changing event.

More particularly, an exemplary embodiments include utilizing data associated with the operation of the feedback management system to determine the delay associated with feedback of the implanted hearing prosthesis (where "delay" includes the "air delay"—the delay associated with signals traveling through the air that create feedback, and the "structural delay"—the delay associated with signals traveling through the structure of the hearing prosthesis and the structure of the recipient). More particularly, in at least some embodiments of the hearing prostheses detailed herein and/or variations thereof, with reference to hearing prosthesis 400 by way of example only and not by way of limitation, there is a delay between the output of the gain equalizer 436 (or, more appropriately, receipt of the output of the gain equalizer 436 by the feedback management system of the prosthesis 400) and the signal from amplifier 434 (or, more appropriately receipt of the output of the microphones 424L and 424R containing the feedback resulting from activation of transducer 440 to evoke a hearing percept). Some exemplary embodiments of the hearing prosthesis detailed herein and/or variations thereof have utilitarian value when these signals are synchronized. That is, there is utilitarian value in temporally synchronizing the baseline data (the data from the gain equalizer 436) with the feedback data (the data from amplifier 434 influenced by the activation of transducer 440). In some exemplary embodiments, temporally synchronizing this data results in improved processing efficiency in that the number of potential so-called "zero passes" is reduced (including eliminated).

More specifically, an exemplary method includes monitoring or otherwise reading the filter coefficients of the adaptive filters (including monitoring or otherwise reading the output of the least mean squares block 495 or any other components of the hearing prosthesis that will enable the teachings herein and/or variations thereof to be practiced) in a manner that also includes a temporal location associated therewith, and determining the delay time of the feedback in a manner that is correlated to operation of the feedback management system. Based on the determined delay time, the feedback management system is adjusted to incorporate this delay (e.g. a delay might be added via the pre-filters 493 etc.) to reduce and/or eliminate the possibility of the zero passes occurring as compared to that which would be the case if the delay time (determined based on operation of the feedback management system) was not accounted for or otherwise addressed.

In this regard, in an exemplary embodiment, there is a method where a sharp impulse signal (or other appropriate signal) is generated by, for example the noise generator 496, that is such that the filter coefficients of the adaptive filters will change in a generally more predictable manner than that of another signal. The method can further include determining the time between the generation of that sharp impulse signal and the change in the filter coefficients, thereby determining the delay time of the feedback. Based on that time, the feedback management system is adjusted. For example, a latency is added to the feedback management system based on this delay time. Accordingly, in an exemplary embodiment there is a method of utilizing a hearing prosthesis with a feedback management system in which the feedback management system includes a latency in the feedback management system that is set based on the operation of the feedback management system such that the feedback management system effectively operates with no zero passes.

In view of the above, it can be seen that in an exemplary method includes adjusting an operational parameter of the feedback management system based on the operation of the feedback management system and/or the determined feedback path parameters, where operational parameters include pre-filter settings, adaptation speed of the feedback algorithm, correlation depth, features associated with latency/impacted by latency. In some embodiments, there are additional operational parameters.

The feedback path parameters, can, in some exemplary embodiments, be frequency dependent. For example, the filter coefficients can be correlated to various frequencies of the output signal of the gain equalizer 436 and/or the output of amplifier 434, etc. For example, the filter coefficients can be correlated to various frequency channels (such as those of the gain equalizer 436, although in other embodiments, there may not be such correlation vis-à-vis the equalizer). In an exemplary embodiment, the feedback path gain margin determined via method action 520 is a frequency dependent feedback path gain margin. In an exemplary embodiment, the calculation of the adaptive filter coefficients can be made in a frequency domain while the rest of the algorithm is working in time domain.

In an exemplary embodiment, the one or more feedback path parameters can be determined based on the output of the least mean squares block 495 (and thus determined based on data related to adaptive filter coefficients of filters of the feedback management system), because, in at least some embodiments, the filter coefficients are set by the least mean squares block 495. With regard to frequency dependence, a fast Fourier transformation (FFT) can be performed or otherwise executed on the output of the least mean squares block 495 and/or the filter coefficients themselves (or data based thereon) to obtain a feedback frequency response. Accordingly, feedback path parameters such as a frequency dependent feedback path gain margin (and/or a non-frequency dependent feedback path gain margin) can be determined based on the data related to the adaptive filter coefficients.

As can be seen from the above, at least some embodiments of the methods detailed herein and/or variations thereof relate to frequency dependent factors. Accordingly, in some embodiments, there is utility in having a filter length of the adaptive filter coefficient of the feedback management system as long as possible. In some embodiments, this increases the resolution of the parameters determined in method action 520 with respect to frequency dependence. That is, in some embodiments, the longer the filter length, the better resolution of the parameters with respect to certain frequencies of interest. That is, the methods detailed herein can yield relatively satisfactory amounts of resolution for certain frequencies utilizing a relatively short frequency path. However these methods, in some instances might yield satisfactory amounts of resolution for other frequencies utilizing that same short frequency path. Thus, an exemplary embodiment includes a method where the filter length is varied depending on a frequency of interest while executing method action 520. In an exemplary embodiment, such a method can have utility in that the resolution of the parameters determined in method action 520 are improved for all frequencies of possible interest. In some embodiments, the method further entails adjusting the filter length dynamically during operation of the feedback management system, at least with respect to operation of the system while the noise generator is functioning (e.g. a feedback path parameter determination stimulus is applied to the hearing prosthesis).

More particularly, increasing the filter length can enhance resolution associated with the feedback path parameters in a meaningful utilitarian manner, at least for lower frequency stimuli (e.g. those below about 500 Hz, those below about 800 Hz, those below about 1000 Hz, those below about 1500 Hz those below about 2000 Hz, those below about 2500 Hz and/or those below about 3000 Hz), and thus there is a method, device and/or system of/for doing such. By way of example and not by way of limitation, in an exemplary embodiment, the resolution of an exemplary filter system can be relative to the sampling frequency of, for example, the digital signal processor of the hearing prosthesis. In an exemplary embodiment of such an exemplary embodiment, a sampling frequency of 20 kHz is used and the length of the filter is 40 taps, and thus the filter resolution in this example is about 500 Hz. In some exemplary embodiments of such, anything below about 500 Hz is not meaningful, and data having more utilitarian value can be found from about 1 kHz and upwards. By increasing the filter length to 80 taps the resolution increases to 250 Hz, and thus anything below about 250 Hz is not meaningful, and data having more utilitarian value can be found from about 500 Hz and upwards, etc.

That is, if the filter length his relatively short, parameters associated with low-frequency signals can be relatively difficult to read (in some embodiments this includes effectively meaningless to read and or effectively impossible to read). In an exemplary embodiment, the filter length can be increased with respect to the time domain and/or the frequency domain. As noted above, some embodiments utilize a fast Fourier transformation to obtain or otherwise determine the feedback path parameters of interest. In some embodiments, the fast Fourier transformation size (N) is adjusted and/or the number of FFT points is adjusted, where increased size/number provides increased resolution with respect to the low frequency signals (stimuli). Again, as noted above, some embodiments include increasing the filter length dynamically. Thus in an exemplary embodiment, at least some of the methods detailed herein and/or variations thereof, the size of the fast Fourier transformation is adjusted in a dynamic manner, thus effectively varying the filter length of the adaptive filters.

It is noted that in at least some embodiments, increasing the filter length results in increased usage of the processing power of the hearing prosthesis and/or the fitting system. Hence, in at least some embodiments, there is utilitarian value in keeping the filter length as short as possible respect to computational speed. Thus, an exemplary method entails balancing the processing power (computational power) of the hearing prosthesis and/or the fitting system against a utilitarian resolution of the parameters of the frequency path to be determined. According to an exemplary embodiment, there is a method that entails the activating or otherwise disabling other processing intensive features of the hearing prosthesis and or the fitting system. By way of example only and not by way of limitation, processing "space" can be opened up by deactivating, for example, directional functionalities such as a beam forming system of the hearing prosthesis. That is, an exemplary method entails increasing an adaptive filter length of the feedback management system and deactivating one or more functions of the hearing prosthesis, and determining the feedback path parameters based on operation of the feedback management system and/or operating the feedback management system with the increased adaptive filter length and the deactivated hearing prosthesis functionality.

Still further, in an exemplary embodiment, there is a method that entails determining or otherwise estimating, over a given frequency range, where, within one or more sub-frequency ranges frequencies of the given frequency range, feedback is more likely to occur as opposed to other sub-frequency ranges. In some variations of this method, the method further includes adjusting the length of the filter coefficients based on the determination of where the feedback is more likely to occur (i.e. the sub-frequency range or ranges within the given frequency range at which the feedback is more likely to occur). In an exemplary embodiment, the method entails increasing the filter length when the determined sub-frequencies correspond to relatively low frequencies and/or decreasing the filter length when the determined sub-frequencies correspond to frequencies higher than the relatively low frequencies.

Still further, in some variations of this method and/or as a stand-alone method, the length of the filter coefficients are adjusted based on the available processing power of the hearing prosthesis and/or the fitting system. Accordingly, in an exemplary embodiment, the filter length is set at a first length when an available processing power of the hearing prosthesis and/or fitting system corresponds to a first value. The method further includes adjusting the filter length from the first length upon a change in the available processing power from the first value. In an exemplary embodiment, the relationship between the change of the first length and the change in the first value is directly correlated (i.e., it is not an inverse relationship). For example if the available processing power is reduced from the first value, the filter length is also reduced from the first value. In an exemplary embodiment, the method entails setting the first value as the default value, where, in some embodiments, the first value represents the longest filter length, and in some embodiments, the first value of the available processing power represents the most available processing power (were power intensive functions of the hearing prosthesis and/or the fitting system are turned off or otherwise deactivated). In an alternate exemplary embodiment, the first value represents the shortest filter length that can yield utilitarian results for at least some frequency ranges, and the first value represents the least available processing power. In some embodiments the first length and the first value represents and in between length and value, respectively.

Still further, in some exemplary embodiments, there is a method that entails adjusting the filter length based on the results of the determination of the feedback path parameters and/or the performance of the feedback management system. For example, the filter length can be set at a length that utilizes acceptable amount of processing power. Upon a determination that the results associated with the filter length are not sufficiently utilitarian, the filter length can be increased. This can result in the reduction of the available processing power (in the case where the hearing prosthesis and/or fitting system was not utilizing all of the available processing power) and/or can result in the automatic and/or manual deactivation of one or more of the functions of the hearing prosthesis and/or the fitting system. Alternatively and/or in addition to this, the filter length can be set at a length that utilizes the maximum amount of available processing power, and is reduced in length as functionalities of the hearing prosthesis and/or the fitting system demand more processing power.

It is noted that in at least some embodiments, at least some, including all, of the aforementioned method actions associated with adjusting the filter length can be performed automatically, as is the case with respect to some, including all, of the other method actions detailed herein.

It is also noted that in some embodiments of the methods detailed above and/or variations thereof, the filter length is also varied based on such parameters as the length in the impulse response of the system, the utilitarian and or desired convergence speed, and the general application requirements.

In another exemplary method that can be a stand-alone method and/or can be a method that is utilized with some or all of the methods detailed herein and/or variations thereof, there is the action of "truing" the data based on the adaptive filter coefficients of the feedback management system. In an exemplary embodiment, this can include the action of setting the pre-filters 493 to a flat frequency filter/a "one filter." Alternatively and/or addition to this, this can entail compensating for these pre-filters (e.g., adding back the filtered out signal and/or adjusting the output of the filter coefficient readings etc.). Alternatively or in addition to this, this can entail bypassing the pre-filters. More particularly, because the feedback path is defined based on the adaptation of the feedback algorithm of a feedback management system (e.g., the filter coefficients), any pre-filtering or the like of the signal prior to reaching the adaptive filters will influence the characterization of the feedback path. Thus, it is necessary to address this pre-filter in order to obtain a true characterization of the feedback path. Any device, system and/or method, they can be utilized to true the data based on the adaptive filter coefficients of the feedback management system in order to enable the feedback path to be defined based on the adaptation of the feedback algorithm of the feedback management system can be utilized in at least some embodiments.

Still further, some embodiments include normalizing the output of and/or data communicated within the feedback management system. In this regard, in some embodiments, data can be normalized to improve calculations and or to improve the ability to evaluate the data relative to non-normalized data. In embodiments where the data is normalized, at least in some embodiments, the normalized data is compensated for by the hearing prosthesis and or an external system, such as a fitting system of the like, in communication with the hearing prosthesis that in whole or in part execute some or all of the method actions detailed herein and/or variations thereof. Compensation can be performed according to any manner that will enable the data to be used according to the teachings detailed herein and/or variations thereof. Alternatively and/or in addition to this, the hearing prosthesis in general, and the feedback management system thereof in particular, and/or the system that communicates there with two practice one or more or all of the method actions detailed herein and/or variations thereof, can have a freezing functionality in order to enhance readability of the data from the feedback management system. In an exemplary embodiment, the adaptive filter system itself includes this freezing capability. Accordingly in an exemplary embodiment, method action 520 includes determining one or more feedback path parameters based on frozen data based on adaptive filter coefficients.

Some exemplary devices and systems that can enable execution of at least some of the method actions detailed herein and/or variations thereof will now be described. In this regard, it is noted that exemplary embodiments include a device and/or a system configured to implement one or more or all of the method actions detailed herein and/or variations thereof, in automatic, semiautomatic, and/or manual manner.

Figure 6:
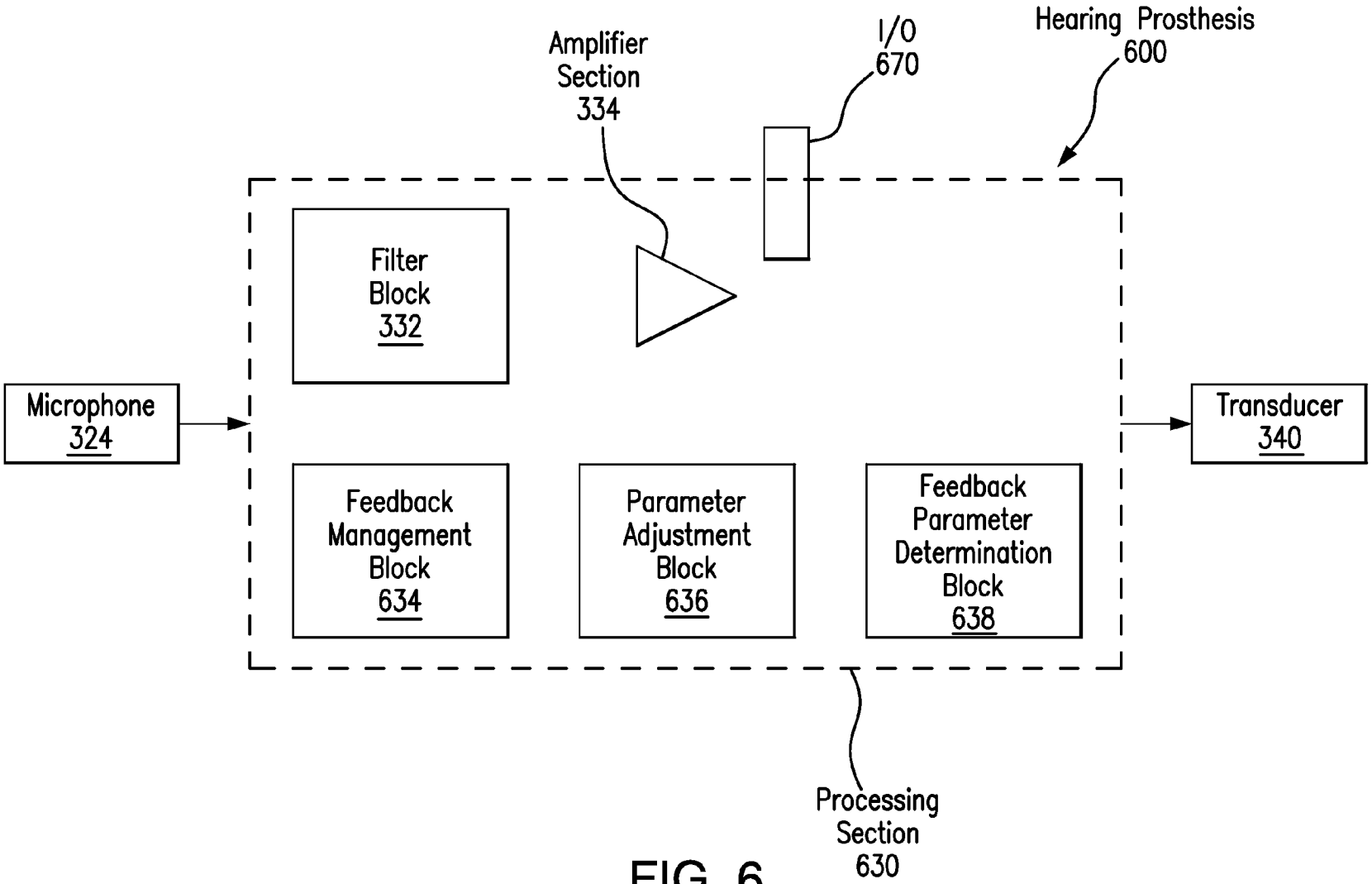
FIG. 6 is a functional diagraph of an embodiment of the hearing prosthesis of FIG. 3.

Referring to FIG. 6, a hearing prosthesis 600 is presented that can be utilized to practice some and/or all of the methods detailed herein and/or variations thereof, with like numbers corresponding to that of FIG. 3. As can be seen, processing section 630 includes filter block 332, and an amplifier section 334, as with hearing prosthesis 300 detailed above. Processing section 630 also includes a feedback management block 634, a parameter adjustment block 636 (e.g., a microcontroller and/or a microprocessor, etc.), which, in an exemplary embodiment, is configured to adjust a parameter of the hearing prosthesis, such as set the gain margin of the hearing prosthesis 600 (automatically and/or in response to input through I/O block 670). In an exemplary embodiment, the parameter adjustment block 636 can be a "smart" device that interprets data and implements a parameter adjustment based on the interpreted data. Alternatively and/or in addition to this, the parameter adjustment block can be a slave device that implements instructions from outside the hearing prosthesis (e.g., such as those from a fitting system, as will be detailed further below). In an exemplary embodiment, the parameter adjustment block 636 can be configured to communicate directly and/or indirectly with the feedback management system to obtain data based on the operation thereof and, based on that data, execute one or more or all of the method actions detailed herein and/or variations thereof associated with adjusting a parameter of the hearing prosthesis 600.

Hearing prosthesis 600 also includes a feedback parameter determination block 638. In an exemplary embodiment, the feedback parameter determination block can be configured to determine one or more parameters of the feedback path based on the operation of the feedback management system. In an exemplary embodiment, the feedback parameter determination block 638 can be configured to communicate directly and/or indirectly with the feedback management system to obtain data based on the operation thereof and, based on that data, execute one or more or all of the method actions detailed herein and/or variations thereof associated with determining the one or more parameters of the feedback path of the hearing prosthesis 600.

Still referring to FIG. 6, I/O block 670 is configured to enable data indicative of the operation of the feedback management block 634 to be read or otherwise obtained from hearing prosthesis 600. In an exemplary embodiment, the data indicative of the operation of the feedback management system includes data based on the adaptive filter coefficients of the adaptive filters of the feedback management block 634. In this regard, such data includes any of the data detailed herein and/or variations thereof pertaining to operation of the feedback management system. For example, data based on the value of the adaptive filter coefficients can be read through I/O block 670, including data from the adaptive filters 494 and/or data from the least mean squares block 495, etc.

I/O block 670 can be used to control parameter adjustment block 636 to adjust one or more parameters of the hearing prosthesis, including the set gain margin (in which case method action 520 can be executed externally of the hearing prosthesis 600). Alternatively and/or in addition to this, I/O block 670 can be used to provide data to the parameter adjustment block 636 such that the parameter adjustment block 636 can determine how to adjust the given parameters (in the case of a smart adjustment block).

I/O block 670 can communicate with fitting software or the like, such as software on a personal computer of an audiologist, so that the system (fitting system plus the prosthesis 600) can be utilized to execute one or more or all of the method actions detailed herein an/or variations thereof, as will now be detailed.

Figure 7:
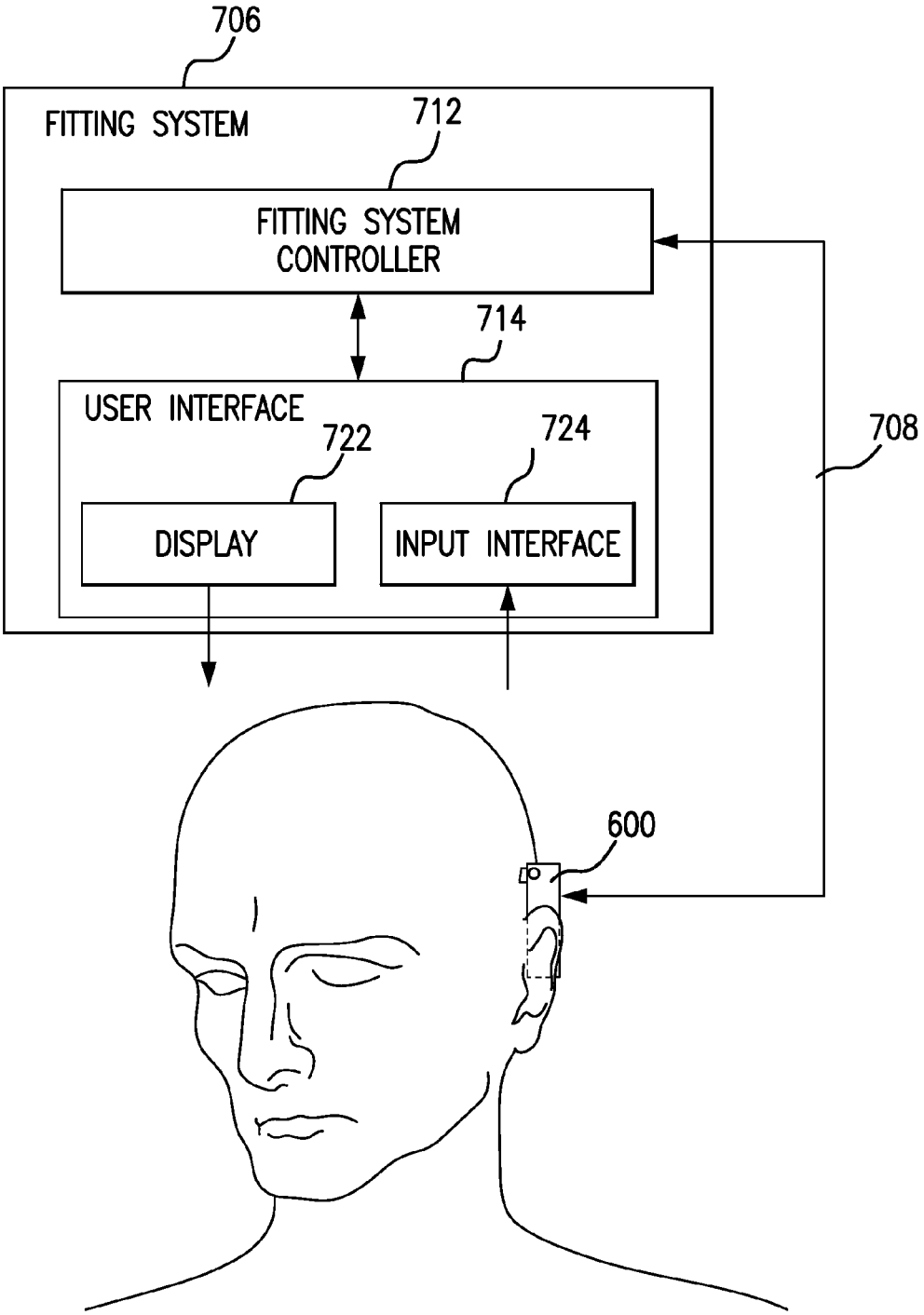
FIG. 7 is a schematic of a fitting system according to an embodiment.

Referring to FIG. 7, there is a presented a schematic diagram illustrating one exemplary arrangement in which a fitting system can be used in conjunction with hearing prosthesis 600. More particularly, hearing prosthesis 600 (represented in a functional manner in FIG. 7) is connected directly to fitting system 706 to establish a data communication link 708 between the hearing prosthesis 600 and fitting system 706. It is noted that this data communication link 708 can be hardwired and/or can be a wireless data communication link. Any device system and/or method that can be utilized to place the hearing prosthesis 600 into community occasion with the fitting system 706 can be utilized in at least some embodiments. Further, fitting system 706 can be a system that is remote from the hearing prosthesis 600. By way of example, the hearing prosthesis 600 can be placed into communication, via for example an Internet connection and/or a cellular phone connection, with a fitting system in another town, city, country, and/or content etc. Fitting system 706 is thereafter either uni-directionally or bi-directionally coupled by the data communication link 708.

Fitting system 706 can include a fitting system controller 712 as well as a user interface 714. Controller 712 can be any type of device capable of executing instructions such as, for example, a general or special purpose computer, digital electronic circuitry, integrated circuitry, specially designed ASICs (application specific integrated circuits), firmware, software, and/or combinations thereof. User interface 714 can comprise a display 722 and an input interface 724. Display 722 can be, for example, any type of display device, such as, for example, those commonly used with computer systems. Input interface 724 can be any type of interface capable of receiving information from a recipient, such as, for example, a computer keyboard, mouse, voice-responsive software, touch-screen (e.g., integrated with display 722), joystick and/or any other data entry or data presentation formats now or later developed.

Still referring to FIG. 7, in an exemplary embodiment, an audiologist or other healthcare professional or the like utilizing fitting system 706 can control the hearing prosthesis 600 via link 708 such that the noise generator 496 generates a noise (or more accurately, generates a noise signal) as detailed herein and/or variations thereof such that the generated noise causes the transducer 440 to transducer energy in a manner such that the feedback management system of the hearing prosthesis 600 is activated. Via the link 708, data based on the adaptive filter coefficients of the adaptive filters of the feedback management system of the hearing prosthesis 600 can be read or otherwise obtained by the fitting system 706. Alternatively and/or in addition to this, by the link 708, other data associated with the feedback management system can be obtained from the hearing prosthesis. Any data or type of data that can be obtained from the hearing prosthesis 600 that can enable the teachings detailed herein and/or variations thereof to be practiced can be utilized by the ending system 706 (and/or any other system including a self-contained system in the hearing prosthesis 600) in at least some embodiments.

The fitting system 706 can determine, automatically, one or more feedback path parameters of the hearing prosthesis 600 based on the operation of the feedback management system resulting from the fitting system 706 activating the noise generator 496. Alternatively and/or in addition to this, the feedback system 706 can display information on display 722 and/or otherwise output information such that the one or more feedback path parameters of the hearing prosthesis can be determined.

It is noted that in an exemplary embodiment, link 708 can be used to insert the noise (signal) generated by the noise generator into the hearing prosthesis (e.g., the noise generator can be remote from the hearing prosthesis) via the I/O block of the hearing prosthesis.

Still further, in another exemplary embodiment, an audiologist or other healthcare professional or the like, still utilizing fitting system 706, can utilize the fitting system 706, via link 708, to set a parameter of the hearing prosthesis based on the operation of the feedback management system of the hearing prosthesis, where indicative of your otherwise associated with the operation of that feedback management system is communicated to the fitting system 706 via the link 708. By way of example, upon receipt of data associated with the feedback management system via link 708 by the fitting system 706, and, optionally, after analysis thereof (automatically by the fitting system 706 and/or manually by the audiologist or other healthcare professional or the like), the fitting system 706 can be used to set the gain margin on the hearing prosthesis 600, again via link 708. In an exemplary embodiment, this can be done by controlling the parameter adjustment block 636 via the link 708 and/or by controlling another component of the hearing prosthesis 600. Alternatively and/or in addition to this, data can be provided by the fitting system 706 to the hearing prosthesis, and the hearing prosthesis itself can make a determination as to how a parameter thereof, such is the gain margin, should be adjusted by the parameter adjustment block 636.

In an exemplary embodiment, there is a non-transitory computer readable media having recorded there on a computer program for implementing one or more or all of the method actions detailed herein and/or variations thereof. In an exemplary embodiment, the computer program is for fitting a hearing prosthesis, such as hearing prosthesis 600. The computer program can include, for example, code for analyzing an operation of the feedback management system of the hearing prosthesis 600 alternatively and/or in addition to this, the computer program can include, also by way of example, code for at least partially fitting the hearing prosthesis 600 to a recipient of the hearing prosthesis based on an analysis of the operation of the feedback management system. In the same vein, in some exemplary embodiments, there are methods analyzing the operation of the feedback management system and/or at least partially fitting the hearing prosthesis to the recipient based on the analysis of the operation of the feedback management system.

By "at least partially fitting the hearing prosthesis to a recipient," it is meant that the code need not be such that it can be used to fully fit the hearing prosthesis to the recipient. That is, there may be other actions associated with fitting the hearing prosthesis taken that is outside the realm of this code. However, in some embodiments, the code is such that it is for fully fitting the hearing prosthesis to the recipient.

To be clear, while some embodiments of the teachings detailed herein and or variations thereof are practiced in conjunction with a fitting system that is separate from the hearing prosthesis, in some exemplary embodiments, the prosthesis 600 and/or variations thereof are configured to execute one or more or all of the method actions detailed herein and/or variations thereof. In this regard, in some embodiments, the hearing prosthesis 600 includes a fitting system, and thus there are some embodiments such that references herein to the fitting system in combination with the hearing prosthesis 600 correspond to a reference to the hearing prosthesis 600.

As noted above, some embodiments include setting a gain margin of the hearing prosthesis based on an operation of the feedback management system thereof. In some prior art methods, the gain margin is set based on data relating to feedback influence (by itself, constituting the feedback path gain margin). However, in at least some prior art methods, the gain margin is also set based on what will be referred to herein as a safety factor gain margin. This safety factor gain margin often attempts to account for the fact that the feedback path gain margin is based on statistical results of a given population (as compared to a specific empirical results based on a specific recipient as can be obtained utilizing the teachings detailed herein and/or variations thereof). That is, it is a conservative safety factor that assumes something along the lines of a worst-case scenario, at least with respect to a statistically significant grouping of a population.

In some exemplary embodiments, the method actions detailed herein and/or variations thereof are utilized to set a gain margin of the hearing prosthesis that is closer to the true gain margin of the hearing prosthesis (i.e., the gain margin that, if the hearing prosthesis was set thereto, the feedback management algorithm performance would be "maxed out"). Accordingly, in an exemplary embodiment, the gain margin can be set, in totality and/or on a frequency by frequency basis, during a fitting session or the like based on a measurement of the feedback path gain margin obtained from the hearing prosthesis while the hearing prosthesis is attached to the recipient, and thus a more accurate result will be obtained, permitting the safety factor to be lower than it otherwise would be in the case of a statistical analysis according to the prior art. Moreover, in at least some embodiments, the gain margin can be set, based on a measurement of the feedback path gain margin obtained from the operation of the feedback management system while the hearing prosthesis is attached to the recipient, and thus a more accurate result will be obtained even as compared to the just described method, thus permitting the safety factor to be even more lower than it otherwise would be in the case of the just described a method. In at least some embodiments, the set gain margin is the feedback path gain margin minus the safety factor gain margin based on the operation of the feedback management system of the specific hearing prosthesis implanted or otherwise prophetically attached to the recipient, and accordingly, the set gain margin is based on this safety factor gain margin (as well as the feedback path gain margin).

An exemplary method includes obtaining feedback data indicative of the feedback path of the hearing prosthesis based on the operation of the feedback management system thereof. In an exemplary embodiment, this action is performed automatically by, for example, the hearing prosthesis itself. In an exemplary embodiment, a hearing prosthesis can have a system that records data related to feedback, such as for example, parameters related to feedback cancellation system of the hearing prosthesis. For example, with respect to the hearing prosthesis, information from the least mean squares block and/or the filters can be obtained during use of the hearing prosthesis. The data can be recorded onboard the hearing prosthesis and/or can be communicated to a remote device. This data can be paired, in a temporal manner, together and/or with other data. Any data that can be utilized to practice the teachings detailed herein and/or variations thereof can be obtained or otherwise paired with the aforementioned in some embodiments. Any method of data logging relating to feedback management system operation can be utilized in some embodiments. Any device or system that can enable such methods of logging can be utilized in some embodiments.

More particularly, the hearing prostheses detailed herein and/or variations thereof can include a feedback data logger. Feedback data logger can include a memory that records or otherwise logs the obtained feedback data indicative of the feedback path of the hearing prosthesis. This obtained feedback data stored/logged in feedback data logger can be accessed via I/O block 670 so that it can be utilized by a clinician or the like to execute method action 520, etc. Alternatively or in addition to this, because in some embodiments prosthesis 600 is configured to execute, optionally automatically, one or more or all of the method actions detailed herein and/or variations thereof, prosthesis 600 is configured, utilizing the data logged by feedback data logger to, for example, set the gain margin thereof based on the data logged by the data logger.

Accordingly, an exemplary embodiment includes a hearing prosthesis configured to determine one or more feedback path parameters of the hearing prosthesis based on the operation of the feedback management system of the hearing prosthesis, either by automatic initiation of an action that causes the feedback management system of the prosthesis to be active while the hearing prosthesis is implanted or otherwise prosthetically attached to the recipient in a manner that enables the one or more feedback path parameters to be determined, or by manual initiation of that action. Alternatively and/or in addition to this, an exemplary embodiment includes a hearing prosthesis configured to set or otherwise adjust one or more parameters thereof (such as the gain margin) based on the operation of the feedback management system of the hearing prosthesis, either by automatic initiation of an action that causes the feedback management system of the prosthesis to be active while the hearing prosthesis is implanted or otherwise prosthetically attached to the recipient in a manner that enables the one or more feedback path parameters to be determined, or by manual initiation of that action.

It is noted that the methods, apparatuses and systems detailed herein and/or variations thereof can be utilized to obtain recipient specific data. More particularly, in at least some embodiments, methods are implemented such that the operation of the feedback management system operates based on a feedback path that includes the recipient of the hearing prosthesis.

It is further noted that the methods, apparatuses and systems detailed herein and/or variations thereof can be utilized to execute one or more or all of the method actions detailed herein and/or variations thereof without processing the output of the sound capture system and the input of the output transducer of the hearing prosthesis beyond that which occurs in the hearing prosthesis itself. That is, an exemplary method includes executing one or more or all of the method actions detailed herein and/or variations thereof where the signal processing associated with hearing prosthesis sound processing utilized to execute those method actions is limited to that of the hearing prosthesis, at least to execute that method. By way of example and not by way of limitation, in an exemplary embodiment, to execute the aforementioned one or more or all of the method actions, the data transmitted to the fitting system 706 via link 708 from the hearing prosthesis 500 is limited to data based on the adaptive filter coefficients of adaptive filters of the feedback management system of the hearing prosthesis. Alternatively and/or in addition to this, in one or more or all of the aforementioned method actions, there is no output to the fitting system/there is no output from the hearing prosthesis corresponding to data based on the output of the sound capture system and/or data based on the input of the output transducer of the hearing prosthesis. All this said, additional method actions can entail such (e.g., in the case of a full-fitting operation where other features, such as frequency based customization of the hearing prosthesis is implemented). That is, it is the method action(s) detailed herein that can, in some embodiments, exclude such, even though the method actions can be practiced with outer method actions that so include such.

Still further, the teachings detailed herein and/or variations thereof can be considered methods of determining feedback parameters based on data representing a feedback model. That is, the filter coefficients, etc., of the feedback management system correspond to a model of the feedback path, as opposed to the true feedback path. Because the sound processing functionality of the hearing prosthesis is used to develop the feedback model, the fitting system need not implement sound processing, at least in order to execute some or all of the method actions detailed herein and/or variations thereof. Accordingly, an exemplary method includes at least partially fitting the hearing prosthesis (and/or executing one or more or all of the method actions detailed herein and/or variations thereof) without processing sound outside of the hearing prosthesis.

The teachings detailed herein and/or variations thereof enable a method of practicing one or more or all of the method actions detailed herein and/or variations thereof without incurring an error associated with a deviation between the truth feedback path and the feedback path as represented by the feedback management system. That is, any of the functional parameters set or otherwise adjusted according to the teachings detailed herein and/or variations thereof can be set based on data obtained in utilizing the very same components that will utilize the functional parameters that are set or otherwise adjusting. Put another way, the measurements associated with feedback are taken utilizing the exact same components that will manage the feedback in the hearing prosthesis. Another way of considering the innovative features detailed herein and/or variations thereof is that the feedback is measured utilizing a unit of measurement that is the same as that utilized to eliminate or otherwise reduce that feedback: filter coefficients.

As detailed above, in at least some embodiments, any adaptive system that can enable the teachings detailed herein and/or variations thereof to be practiced can be utilized in at least some embodiments. While the teachings detailed herein have generally been directed towards operation of a feedback management system, it is noted that in at least some exemplary embodiments, there are methods, devices and/or systems as detailed herein where reference to operation of a feedback management system is substituted by operation of an adaptive system, where the adaptive system is an adaptive system that enables the teachings detailed herein and/or variations thereof to be practiced. In some embodiments, the adaptive system is part of/is the feedback management system, while in other embodiments, it is part of another system.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A method, comprising:

operating an adaptive system that is part of a feedback management system of a hearing prosthesis with the hearing prosthesis at a set functional parameter;

determining one or more feedback path parameters of the hearing prosthesis based on the operation of the adaptive system of the hearing prosthesis;

decreasing an adaptive filter length of the adaptive system from a previous adaptive filter length previously used during operation of the adaptive system;

operating the adaptive system of the feedback management system of the hearing prosthesis with the decreased adaptive filter length; and adjusting the functional parameter of the hearing prosthesis from a previous setting to a new setting based on the operation of the adaptive system with the decreased adaptive filter length; and wherein the functional parameter of the hearing prosthesis is a gain margin of the hearing prosthesis.

2. The method of claim 1, wherein the action of determining one or more feedback path parameters includes determining the one or more feedback path parameters based on data related to an output of a sound capture system and data related to an input of an output transducer of the hearing prosthesis.

3. The method of claim 1, wherein the action of determining one or more feedback path parameters includes determining the one or more feedback path parameters based on data related to operation of a feedback algorithm gain reduction system of a feedback management system which the adaptive system is a part.

4. The method of claim 1, wherein the action of determining one or more feedback path parameters includes determining the one or more feedback path parameters based on a noise signal having a path extending from an origination location to an output transducer without passing through a sound capture system of the hearing prosthesis, wherein noise signals originating from the origination location are the only noise signals used in the method.

5. The method of claim 1, wherein:

a feedback path of the one or more feedback path parameters includes a path extending from an output of the hearing prosthesis through tissue of the recipient.

6. The method of claim 1, further comprising:

activating one or more functions of the hearing prosthesis, and determining the one or more feedback path parameters based on operation of the feedback management system with the decreased adaptive filter length and the activated hearing prosthesis functionality.

7. The method of claim 1, wherein:

the action of decreasing the adaptive filter length is executed based on a result of the determination of the one or more feedback path parameters.

8. The method of claim 1, wherein:

the action of decreasing the adaptive filter length is executed based on a result of the determination of the one or more feedback path parameters; and the action of decreasing the adaptive filter length is executed after an action of increasing the adaptive filter length.

9. A method, comprising:

utilizing a hearing prosthesis with the hearing prosthesis at a set functional parameter, the hearing prosthesis including a feedback management system that includes an adaptive system;

increasing an adaptive filter length of the adaptive system from a previous adaptive filter length previously used during operation of the adaptive system;

operating the adaptive system of the feedback management system of the hearing prosthesis with the increased adaptive filter length; and adjusting the functional parameter of the hearing prosthesis from a previous setting to a new setting based on the operation of the adaptive system with the increased adaptive filter length, wherein the functional parameter of the hearing prosthesis is a gain margin of the hearing prosthesis.

10. The method of claim 9, wherein the hearing prosthesis is prosthetically attached to a recipient when the adaptive system of the feedback management system is operated.

11. The method of claim 9, further comprising:

automatically setting the functional parameter of the hearing prosthesis based on the operation of the adaptive system.

12. The method of claim 9, further comprising:

operating the hearing prosthesis such that a feedback loop exists that includes a path extending from an output of the hearing prosthesis through tissue of the recipient, wherein the operation of the adaptive system operates at least in part to feedback of the feedback loop.

13. The method of claim 9, further comprising:

setting the adaptive filter length at a first length when an available processing power of the hearing prosthesis corresponds to a first value; and executing the action of increasing the adaptive filter length upon a change in the available processing power from the first value, wherein the action of increasing the adaptive filter length entails increasing the adaptive filter length from the first length.

14. The method of claim 13, wherein:

the change in the available processing power from the first value is an increase in the available processing power from the first value.

15. The method of claim 9, further comprising:

ascertaining available processing power of the hearing prosthesis, wherein the action of increasing the adaptive filter length is executed based on results of the ascertaining of the available processing power.

16. The method of claim 9, wherein:

the action of increasing the adaptive filter length is performed for one or more sub-frequency ranges of sound captured by the hearing prosthesis; and the method further comprises:

decreasing the adaptive filter length for other frequency ranges other than the one or more sub-frequency ranges of sound captured by the hearing prosthesis.

17. The method of claim 9, further comprising:

automatically adjusting the adaptive filter length based on available processing power of the hearing prosthesis, wherein the action of increasing the adaptive filter length is automatically executed upon a determination that available processing power has increased from that which was previously the case prior to the increase in the adaptive filter length.

18. The method of claim 9, further comprising:

deactivating at least one function of the hearing prosthesis upon increasing the adaptive filter length of the adaptive system.

19. The method of claim 9, wherein:

the hearing prosthesis is configured such that increased adaptive filter length requires increased usage of processing power relative to that which was the case prior to the increased adaptive filter length, the method further comprising:

at least partially negating the increased usage of processing power by adjusting a feature of the hearing prosthesis upon increasing the adaptive filter length of the adaptive system.

20. An apparatus, comprising:

a hearing prosthesis including a feedback management system that includes an adaptive system, wherein the hearing prosthesis is configured to output data indicative of operation of the feedback management system, and wherein the hearing prosthesis is configured such that a functional parameter of the hearing prosthesis can be adjusted from a previous setting to a new setting and set at the new setting, wherein the hearing prosthesis is configured so that an adaptive filter length of the adaptive system is increasable from a previous adaptive filter length previously used during operation of the adaptive system;

the hearing prosthesis is configured to be operated such that the adaptive system of the feedback management system of the hearing prosthesis is operated with an increased adaptive filter length relative to that at which the feedback management system was previously operated;

the hearing prosthesis is configured such that the functional parameter of the hearing prosthesis is adjustable from the previous setting to the new setting based on the operation of the adaptive system with the increased adaptive filter length; and the functional parameter of the hearing prosthesis is a gain margin of the hearing prosthesis.

21. The apparatus of claim 20, wherein:

the feedback management system includes a freezing functionality.

22. The apparatus of claim 20, wherein:

the hearing prosthesis is an implantable hearing prosthesis.

23. The apparatus of claim 20, wherein:

the hearing prosthesis is selected from the group consisting of a bone conduction device and a middle ear implant.

24. A non-transitory computer readable medium having recorded thereon, a computer program for an implantable hearing prosthesis, comprising:

code for analyzing an operation of a feedback management system of the implantable hearing prosthesis based on utilization of the implantable hearing prosthesis with the implantable hearing prosthesis at a set functional parameter, the implantable hearing prosthesis including the feedback management system that includes an adaptive system;

code for increasing an adaptive filter length of the adaptive system from a previous adaptive filter length previously used during operation of the adaptive system;

code for operating the adaptive system of the feedback management system of the implantable hearing prosthesis with the increased adaptive filter length; and code for adjusting the functional parameter of the implantable hearing prosthesis from a previous setting to a new setting based on the operation of the adaptive system with the increased adaptive filter length, wherein the functional parameter of the implantable hearing prosthesis is a gain margin of the implantable hearing prosthesis.

25. The computer readable medium of claim 24, further comprising:

code for at least partially fitting the implantable hearing prosthesis to the recipient thereof based on a frequency dependent feedback path gain margin.

* * * * *